US012172737B2

(12) United States Patent
Gallagher

(10) Patent No.: US 12,172,737 B2
(45) Date of Patent: Dec. 24, 2024

(54) SEMI-AUTONOMOUS IMMERSIBLE WATERBORNE DOCK ENCLOSURE

(71) Applicant: Hugh Francis Gallagher, Lakeway, TX (US)

(72) Inventor: Hugh Francis Gallagher, Lakeway, TX (US)

( * ) Notice: Subject to any disclaimer, the term of this patent is extended or adjusted under 35 U.S.C. 154(b) by 343 days.

(21) Appl. No.: 17/838,185

(22) Filed: Jun. 11, 2022

(65) Prior Publication Data

US 2023/0399085 A1 Dec. 14, 2023

(51) Int. Cl.

| | |
|---|---|
| ***B63C 7/16*** | (2006.01) |
| ***B63C 7/02*** | (2006.01) |
| ***B63G 8/00*** | (2006.01) |
| ***B63G 8/04*** | (2006.01) |
| ***B63G 8/08*** | (2006.01) |
| ***B63G 8/22*** | (2006.01) |
| ***B63H 11/08*** | (2006.01) |

(52) U.S. Cl.

CPC ..... *B63C 7/16* (2013.01); *B63C 7/02* (2013.01); *B63G 8/001* (2013.01); *B63G 8/04* (2013.01); *B63G 8/08* (2013.01); *B63G 8/22* (2013.01); *B63H 11/08* (2013.01); *B63G 2008/004* (2013.01)

(58) Field of Classification Search

CPC .. B63C 7/16; B63C 7/02; B63G 8/001; B63G 8/04; B63G 8/08; B63G 8/22; B63G 2008/004; B63H 11/08

See application file for complete search history.

(56) References Cited

U.S. PATENT DOCUMENTS

| | | | |
|---|---|---|---|
| D197,868 | S | 3/1964 | Thornton |
| 3,616,773 | A | 11/1971 | Lloyd |
| 3,653,354 | A | 4/1972 | Pangalila |
| 3,673,974 | A | 7/1972 | Harper |
| 3,763,809 | A | 10/1973 | Pazos |
| 3,771,481 | A | 11/1973 | Goren et al. |
| 3,835,800 | A | 9/1974 | Lloyd et al. |
| 3,857,352 | A | 12/1974 | Schott |
| 3,946,684 | A | 3/1976 | Sumner |
| RE29,167 | E | 4/1977 | Lloyd |

(Continued)

FOREIGN PATENT DOCUMENTS

JP 2002362492 A * 12/2002

*Primary Examiner* — Anthony D Wiest
(74) *Attorney, Agent, or Firm* — David S. Alavi

(57) ABSTRACT

A waterborne vessel includes a hull structure, longitudinal and transverse drive tunnels, and one or more thrusters. The hull structure has a base and side walls forming a U-shaped cross-section, open forward and aft ends, and an open top. The drive tunnels extend through the base portion of the hull structure. Each thruster is located at a corresponding intersection of longitudinal and transverse drive tunnels. Each thruster drives water flow through the corresponding drive tunnels and is rotatable about a vertical axis among multiple different thruster orientations in which the thruster drives water flow in one direction or the other through the corresponding longitudinal or transverse drive tunnel. A method includes: lowering the vessel through water to a submerged target payload; maneuvering the vessel and/or payload to position the payload on the hull structure between the side walls; and raising the vessel and payload toward the water surface.

30 Claims, 25 Drawing Sheets

(56) References Cited

U.S. PATENT DOCUMENTS

| | | | | |
|---|---|---|---|---|
| RE29,478 | E | 11/1977 | Goren et al. | |
| 4,091,760 | A | 5/1978 | Lloyd | |
| 4,150,635 | A | 4/1979 | Lloyd et al. | |
| 4,165,702 | A | 8/1979 | Lloyd et al. | |
| 4,166,426 | A | 9/1979 | Lloyd | |
| 4,257,718 | A | 3/1981 | Rosa et al. | |
| 4,273,067 | A | 6/1981 | Lloyd et al. | |
| 4,281,615 | A | 8/1981 | Wilson et al. | |
| 4,312,287 | A | 1/1982 | Kuo | |
| 4,436,050 | A | 3/1984 | Liden | |
| 4,471,708 | A | 9/1984 | Wilson et al. | |
| 4,646,672 | A | 3/1987 | Bennett et al. | |
| 4,690,086 | A | 9/1987 | McKenna | |
| 4,899,682 | A | 2/1990 | Pouget et al. | |
| 4,909,174 | A | 3/1990 | Bowes | |
| 5,038,702 | A | 8/1991 | Bowes | |
| 5,289,793 | A * | 3/1994 | Aker | B63H 11/08 440/46 |
| 5,607,260 | A | 3/1997 | Khachaturian | |
| 5,609,441 | A | 3/1997 | Khachaturian | |
| 5,662,434 | A | 9/1997 | Khachaturian | |
| 5,800,093 | A | 9/1998 | Khachaturian | |
| 5,975,807 | A | 11/1999 | Khachaturian | |
| 6,039,506 | A | 3/2000 | Khachaturian | |
| 6,149,350 | A | 11/2000 | Khachaturian | |
| 6,247,421 | B1 | 6/2001 | Ludwigson | |
| 6,260,502 | B1 | 7/2001 | Kratz | |
| 6,318,931 | B1 | 11/2001 | Khachaturian | |
| 6,364,574 | B1 | 4/2002 | Khachaturian | |
| 6,367,399 | B1 | 4/2002 | Khachaturian | |
| 6,378,450 | B1 | 4/2002 | Begnaud et al. | |
| 6,425,710 | B1 | 7/2002 | Khachaturian | |
| 6,435,773 | B1 | 8/2002 | Khachaturian | |
| 6,435,774 | B1 | 8/2002 | Khachaturian | |
| 6,524,049 | B1 | 2/2003 | Minnes | |
| 6,668,747 | B2 | 12/2003 | Kjerstad | |
| 6,692,190 | B2 | 2/2004 | Khachaturian | |
| 6,719,495 | B2 | 4/2004 | Khachaturian | |
| 7,527,006 | B2 | 5/2009 | Khachaturian | |
| 7,845,296 | B1 | 12/2010 | Khachaturian | |
| 7,886,676 | B2 | 2/2011 | Khachaturian | |
| 7,908,988 | B1 | 3/2011 | Khachaturian | |
| 7,985,108 | B1 | 7/2011 | Bekker et al. | |
| 8,061,289 | B2 | 11/2011 | Khachaturian | |
| 8,240,264 | B2 | 8/2012 | Khachaturian | |
| 8,240,265 | B1 | 8/2012 | Khachaturian | |
| 9,446,825 | B1 | 9/2016 | Gallagher | |
| 2002/0092456 | A1 | 7/2002 | Begnaud et al. | |
| 2010/0162935 | A1 | 7/2010 | Khachaturian | |
| 2011/0203507 | A1 | 8/2011 | Elinor | |
| 2012/0073485 | A1 | 3/2012 | Khachaturian | |
| 2012/0118215 | A1 | 5/2012 | Tosello | |

* cited by examiner

SEMI-AUTONOMOUS IMMERSIBLE WATERBORNE DOCK ENCLOSURE

FIELD OF THE INVENTION

The field of the present invention relates to waterborne recovery vessels. A semi-autonomous waterborne immersible dock enclosure is disclosed.

SUMMARY

A waterborne vessel includes a hull structure, one or more longitudinal drive tunnels, one or more transverse drive tunnels, and one or more thrusters. The hull structure includes a horizontal base portion, a port vertical side wall, and a starboard vertical side wall. The side walls are attached to the base in a generally longitudinal, transversely spaced-apart arrangement so that the hull structure has a generally U-shaped transverse cross-section, open forward and aft ends, and an open top. The longitudinal and transverse drive tunnels are formed within and extend through the base portion of the hull structure. Each transverse drive tunnel intersects each longitudinal drive tunnel. Each thruster is located within a corresponding longitudinal and transverse drive tunnel at a corresponding intersection thereof. Each thruster drives water flow through the corresponding drive tunnels and is rotatable about a corresponding vertical axis among multiple different thruster orientations. In those different orientations the thruster drives water flow in one direction or the other through the corresponding longitudinal or transverse drive tunnel.

A method employing the waterborne vessel includes: (A) lowering the waterborne vessel into a body of water to a position adjacent a submerged target payload; (B) maneuvering one or both of the waterborne vessel or the target payload to position the target payload on the base portion of the hull structure between the side walls; and (C) raising the waterborne vessel toward a surface of the body of water with the target payload on the base portion of the hull structure between the side walls.

The waterborne vessel can further include one or more oblique drive tunnels formed within the base portion of the hull structure. Each oblique drive tunnel extends horizontally from a corresponding intersection of longitudinal and transverse drive tunnels and terminates at an openings on a bottom surface of the hull structure. The corresponding thruster can rotate to an orientation in which the thruster drives water through the oblique drive tunnel and out through the corresponding opening.

Objects and advantages pertaining to immersible recovery vessels may become apparent upon referring to the example embodiments illustrated in the drawings and disclosed in the following written description or appended claims.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

FIGS. 6A and 6B are partially transparent perspective views that show the arrangement of the drive tunnels; FIGS. 6C and 6E include structural ribs; FIG. 6D includes recesses between the drive tunnels.

Figure 1A:
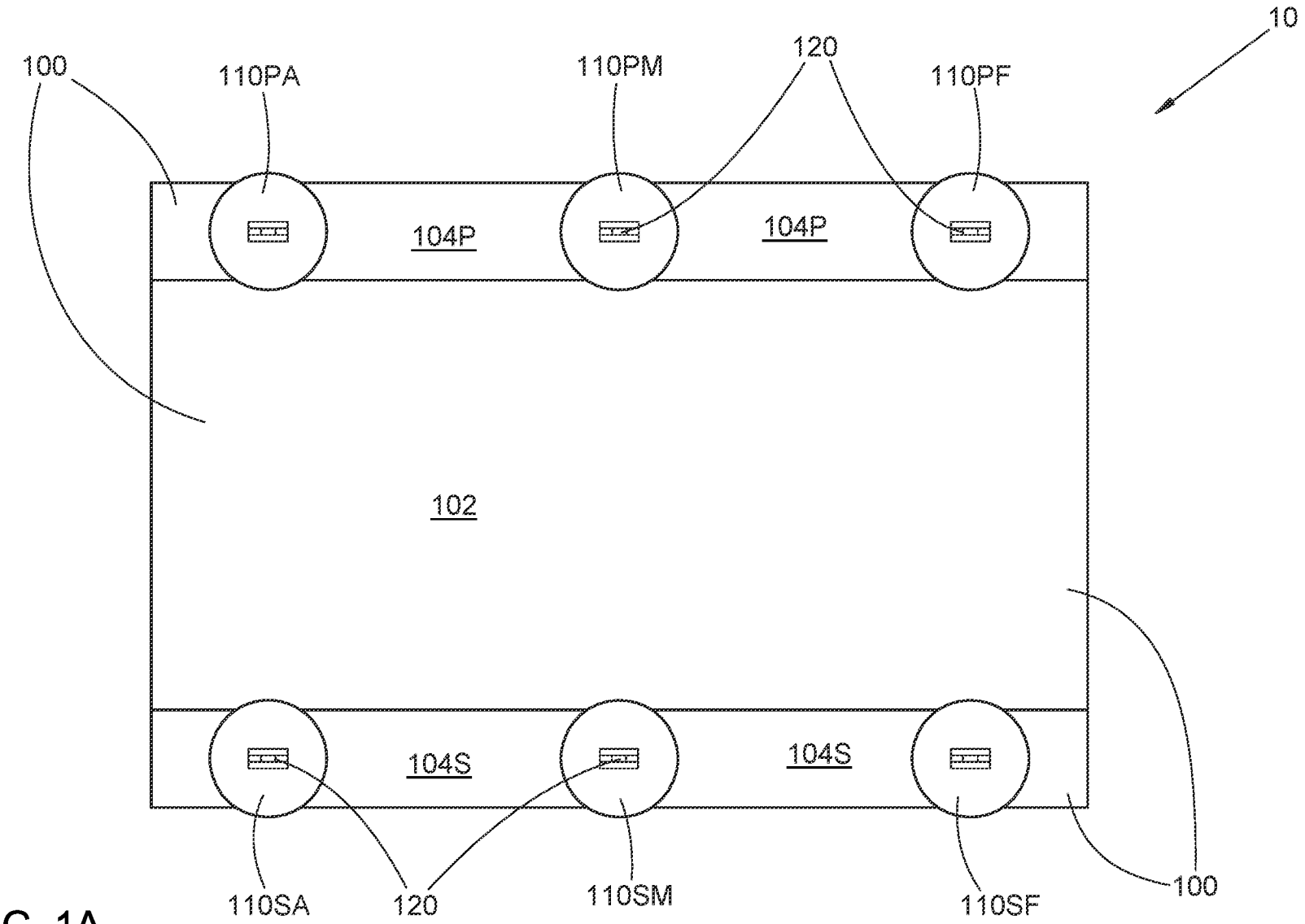
FIGS. 1A through 1F are schematic top, right (starboard) side, left (port) side, back (aft), front (forward), and bottom views, respectively, of an example waterborne vessel. Drive tunnels are shown using dashed lines in FIGS. 1B through 1F; thrusters are omitted from FIG. 1F.
Figure 1B:
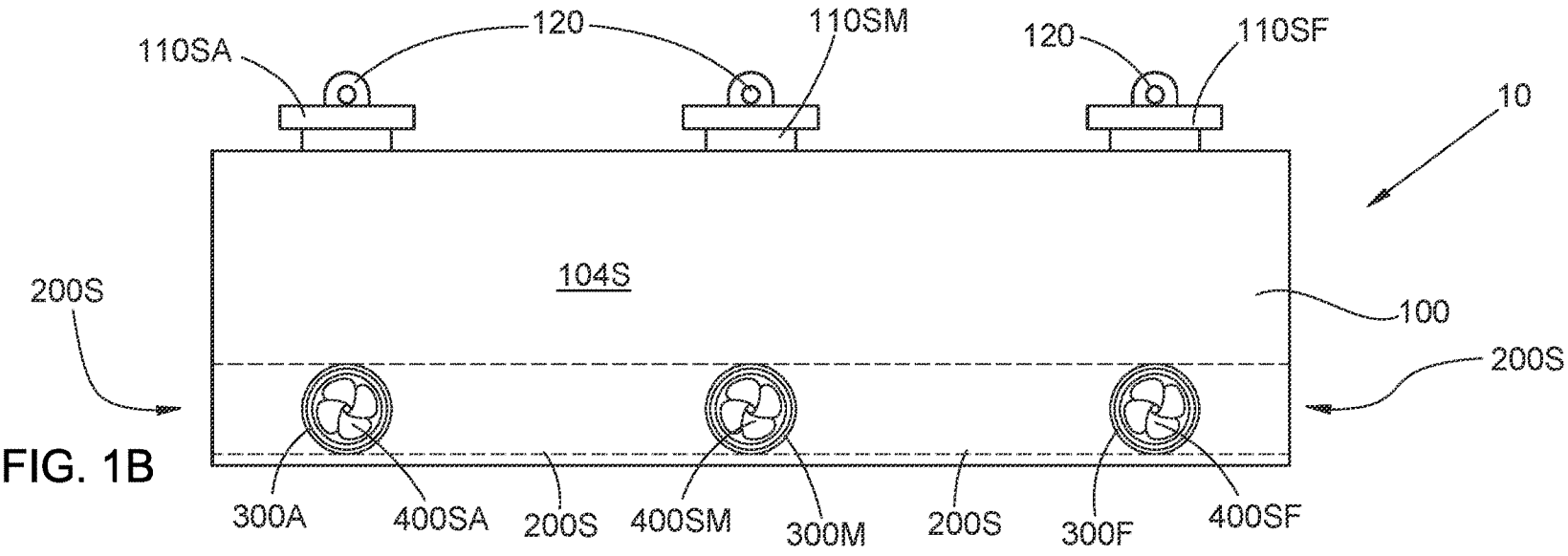
Figure 1C:
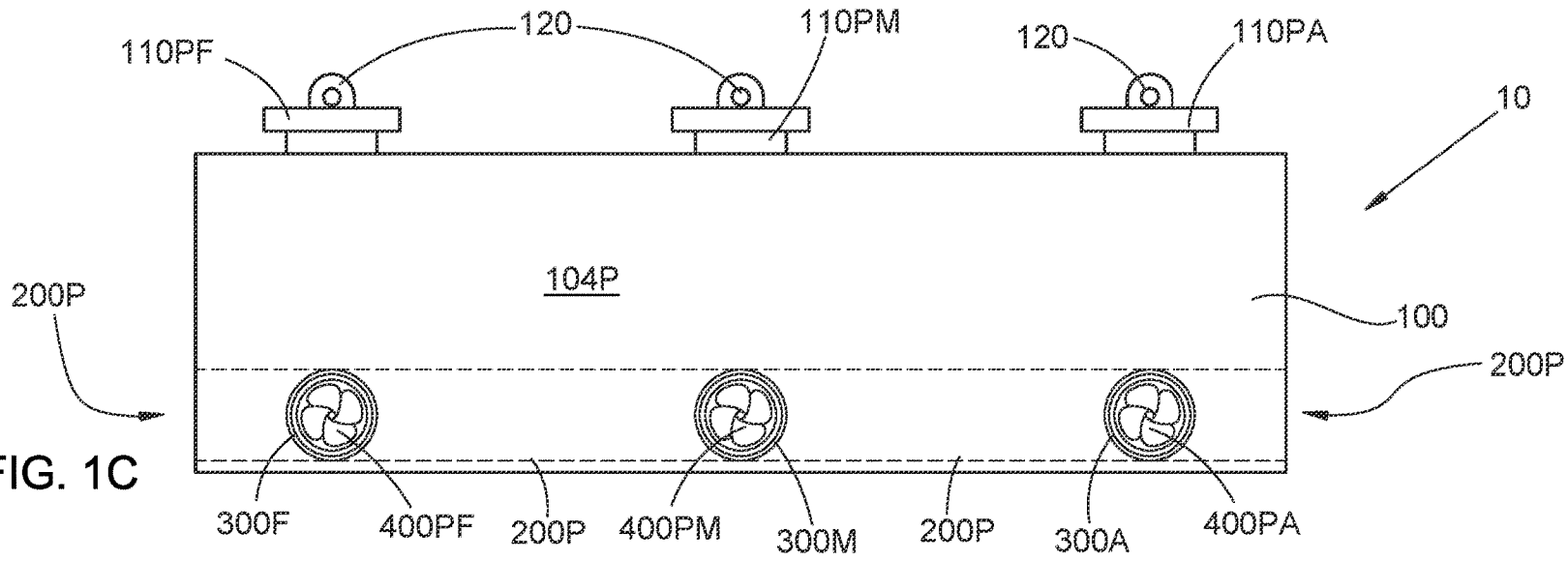
Figure 1D:
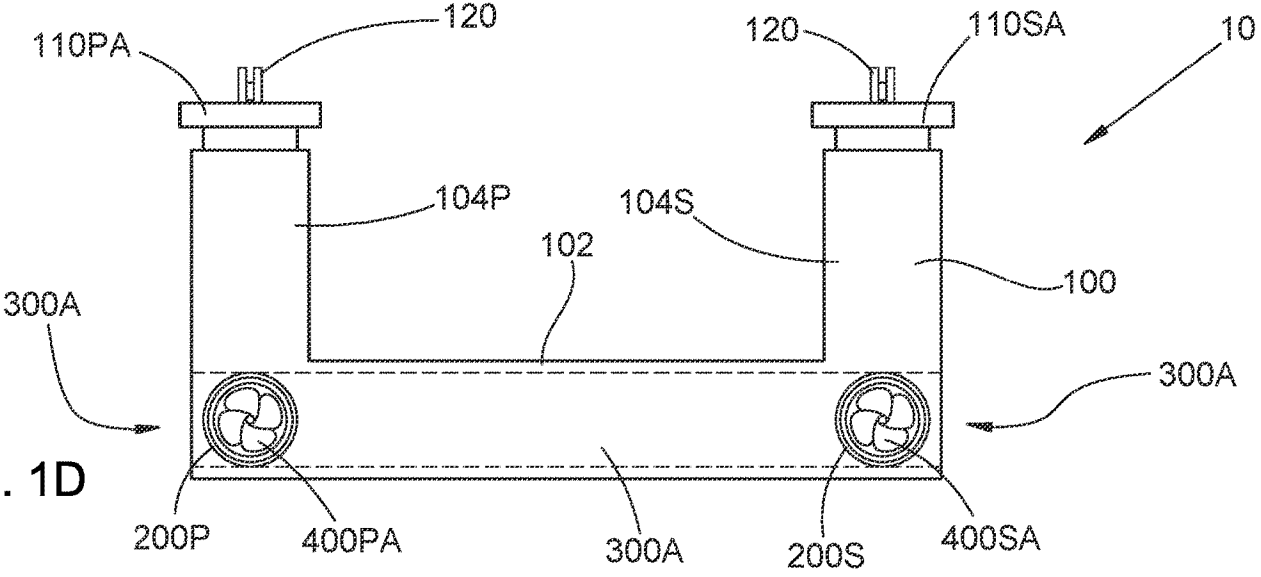
Figure 1E:
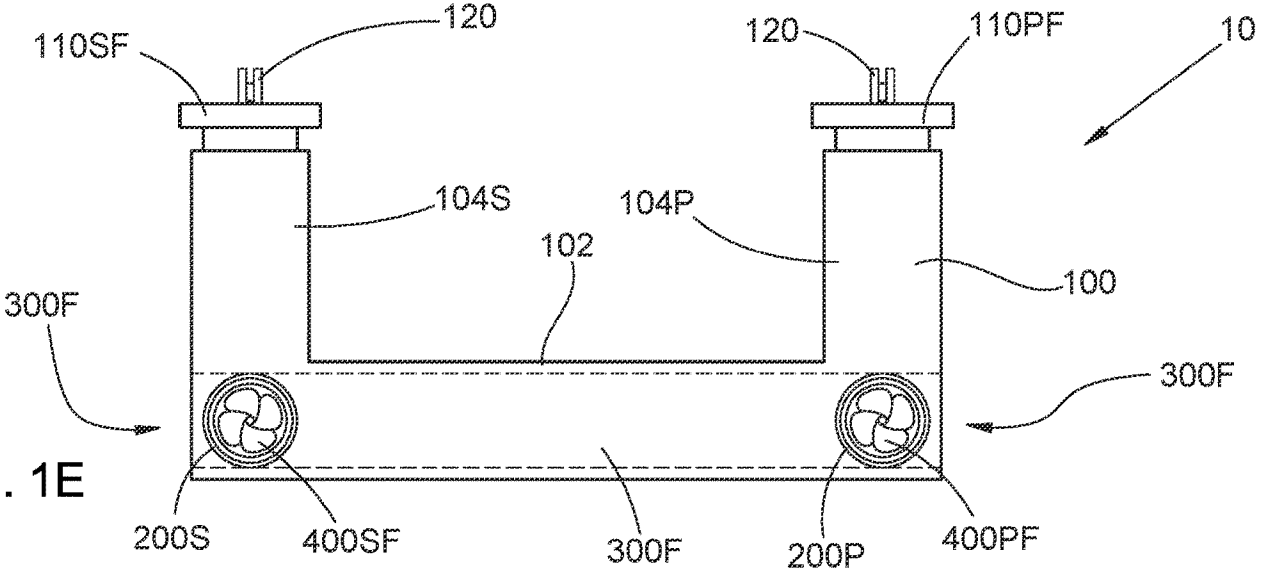
Figure 1F:
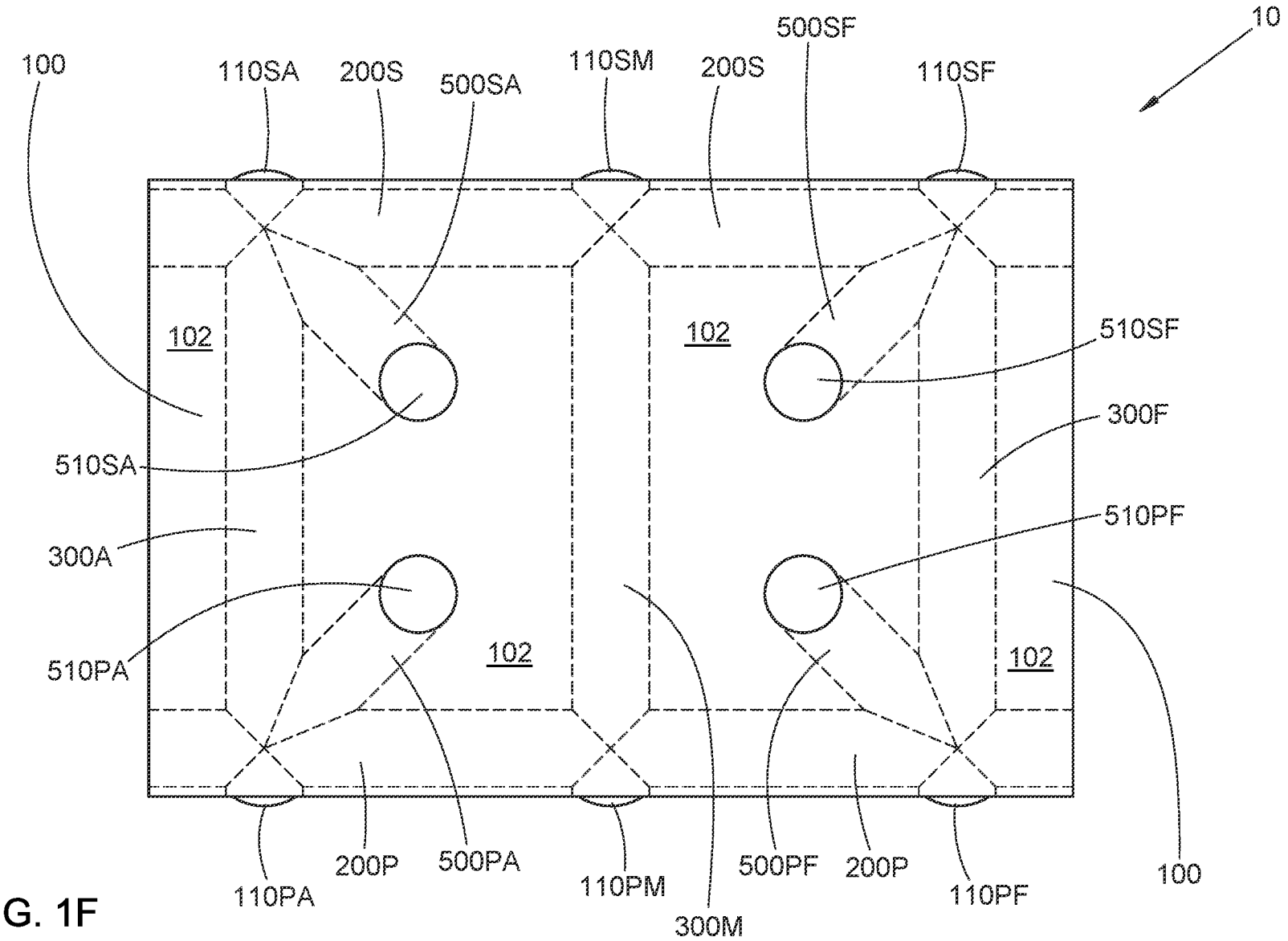

The embodiments depicted are shown only schematically; all features may not be shown in full detail or in proper proportion; for clarity certain features or structures may be exaggerated or diminished relative to others or omitted entirely; the drawings should not be regarded as being to scale unless explicitly indicated as being to scale. The embodiments shown are only examples and should not be construed as limiting the scope of the present disclosure or appended claims.

DETAILED DESCRIPTION

The following detailed description should be read with reference to the drawings, in which identical reference numbers refer to like elements throughout the different figures. The drawings, which are not necessarily to scale, depict selective examples and are not intended to limit the scope of the inventive subject matter. The detailed description illustrates by way of example, not by way of limitation, the principles of the inventive subject matter.

An example of an inventive waterborne vessel 10 is illustrated schematically in the block diagrams of FIGS. 1A through 1F; more realistic renderings illustrating contours of various example arrangements of the vessel 10 are shown in FIGS. 6A through 6E. The vessel 10 can also be referred to as a Semi-Autonomous, Dry-wet dock, Immersible Enclosure (i.e., SADIE). The waterborne vessel 10 includes a hull structure 100, one or more longitudinal drive tunnels 200, one or more transverse drive tunnels 300, and one or more thrusters 400.

The hull structure 100 (also referred to as hull 100) includes a horizontal base portion 102, a port (i.e., left) vertical side wall 104P, and a starboard (i.e., right) vertical side wall 104S; those side walls may be referred to collectively or generically as side walls 104. In some examples the base portion 102 can be arranged as a catamaran with two hulls or pontoons connected by a deck between them. The side walls 104 are attached to the base portion 102 in a generally longitudinal, transversely spaced-apart arrangement so that the hull structure 100 has a generally U-shaped transverse cross-section, open forward and aft ends, and an open top. In catamaran-type examples each vertical side wall 104 can be positioned over one or the pontoon hulls. In some examples (including the examples shown) the hull structure 100 is symmetric, i.e., the two ends of the hull structure 100 are substantially identical, and designations of "forward", "aft", "port", and "starboard" are arbitrary and made only for convenience of description. In other examples (not shown, but falling within the scope of the present disclosure and claims), the hull structure 100 can have distinct forward and aft ends, and the designations of "forward", "aft", "port", and "starboard" would have their usual meanings.

The one or more longitudinal drive tunnels 200 are formed within and extend through the base portion 102 of the hull structure 100; similarly, the one or more transverse drive tunnels 300 are formed within and extend through the base portion 102 of the hull structure 100. In some examples (e.g., as in FIGS. 6A, 6D, and 6E) grates can cover the ends of the tunnels 200/300 to prevent objects from entering the tunnels; in some examples (not shown) the ends of the tunnels can be provided with doors or hatches that can be opened or closed as needed or desired. Each transverse drive tunnel 300 intersects each longitudinal drive tunnel 200. The examples shown include a port longitudinal drive tunnel 200P and a starboard longitudinal drive tunnel 200S, which can be referred to collectively or generally as the longitudinal drive tunnels 200; other examples can have different numbers of longitudinal drive tunnels 200. In catamaran-type examples each pontoon hull can house one of the longitudinal drive tunnels 200 (e.g., as in FIGS. 6A, 6B, 6C, and 6E). In the examples shown the longitudinal drive tunnels 200 are intersected by a forward transverse drive tunnel 300F, an aft transverse drive tunnel 300A, and a midship transverse drive tunnel 300M, which can be referred to collectively or generally as transverse drive tunnels 300; other examples can include other numbers of transverse drive tunnels 300.

The thrusters 400 can be of any suitable type or arrangement, e.g., Schottel retractable thrusters (Model #SRP-R). Each thruster 400 is located within corresponding longitudinal and transverse drive tunnels 200/300 at their intersection. In the examples shown (i) a port forward thruster 400PF is located at the intersection of the port longitudinal drive tunnel 200P and the forward transverse drive tunnel 300F, (ii) a port midship thruster 400PM is located at the intersection of the port longitudinal drive tunnel 200P and the midship transverse drive tunnel 300M, (iii) a port aft thruster 400PA is located at the intersection of the port longitudinal drive tunnel 200P and the aft transverse drive tunnel 300A, (iv) a starboard forward thruster 400SF is located at the intersection of the starboard longitudinal drive tunnel 200S and the forward transverse drive tunnel 300F, (v) a starboard midship thruster 400SM is located at the intersection of the starboard longitudinal drive tunnel 200S and the midship transverse drive tunnel 300M, and (vi) a starboard aft thruster 400SA is located at the intersection of the starboard longitudinal drive tunnel 200S and the aft transverse drive tunnel 300A. Those thrusters can be referred to collectively or generally as thrusters 400.

Figure 2A:
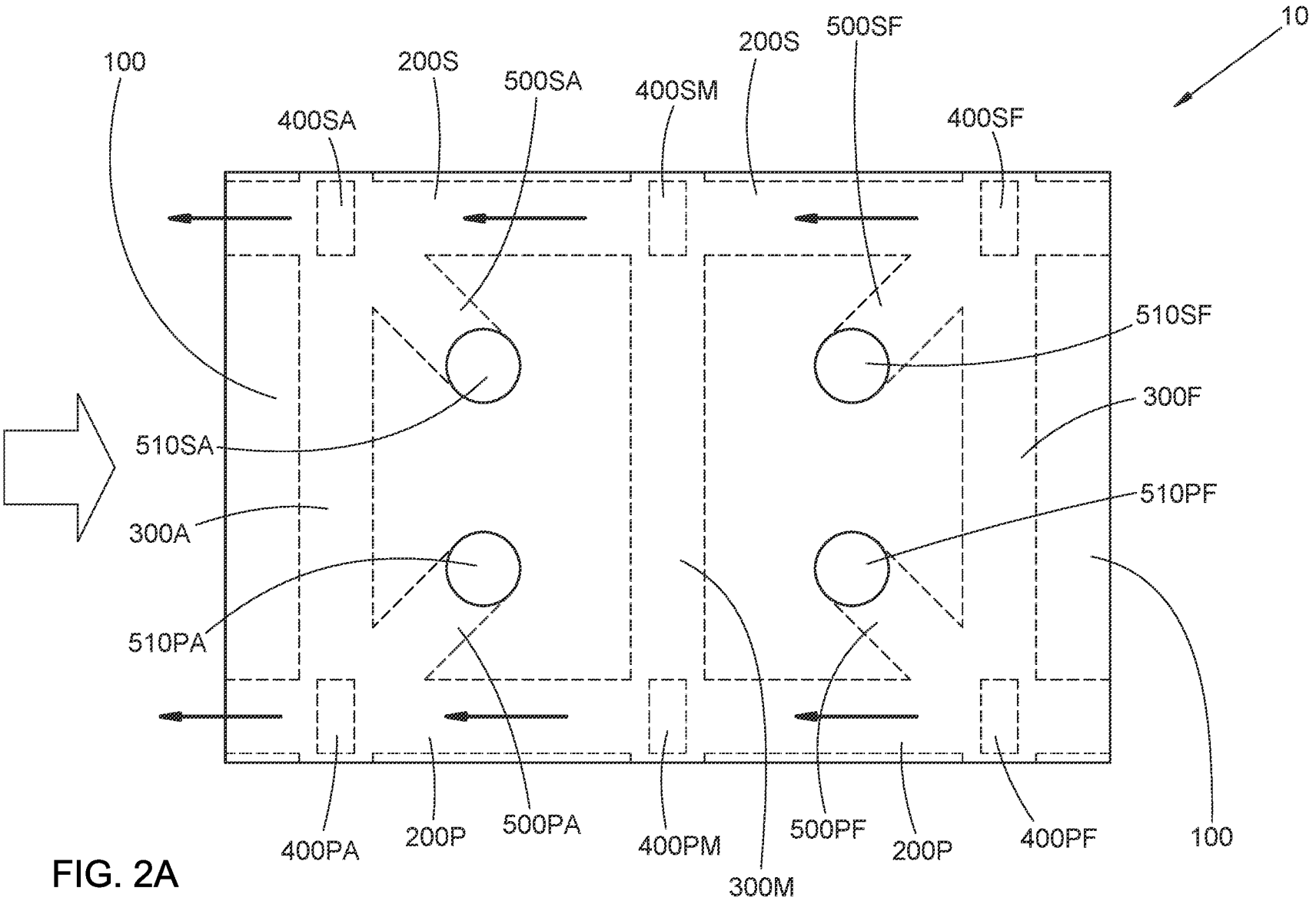
FIGS. 2A through 2E are schematic bottom views of an example waterborne vessel, with drive tunnels and thrusters shown using dashed lines, and illustrate schematically different thruster orientations, resulting water flow through drive tunnels, and resulting thrust.
Figure 2B:
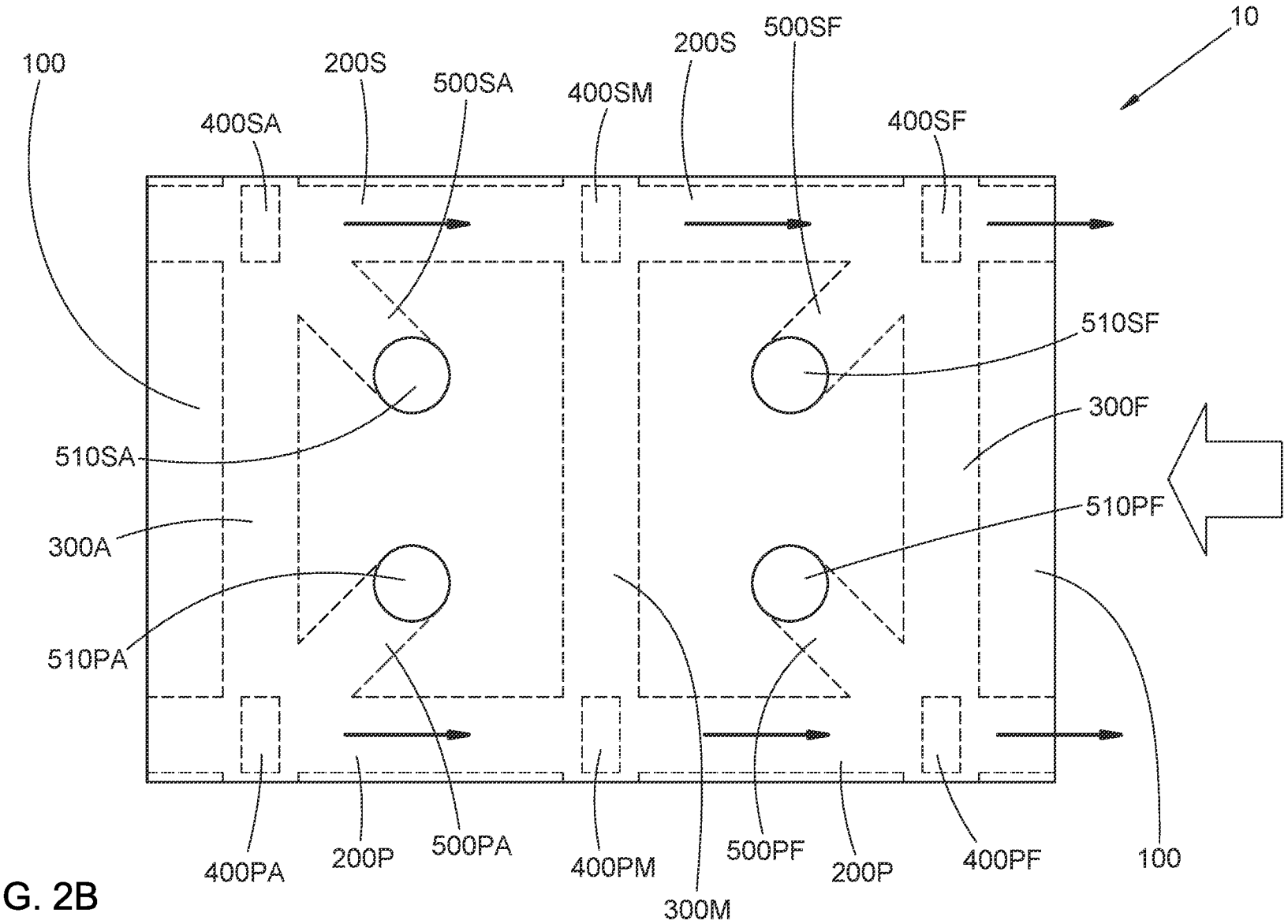
Figure 2C:
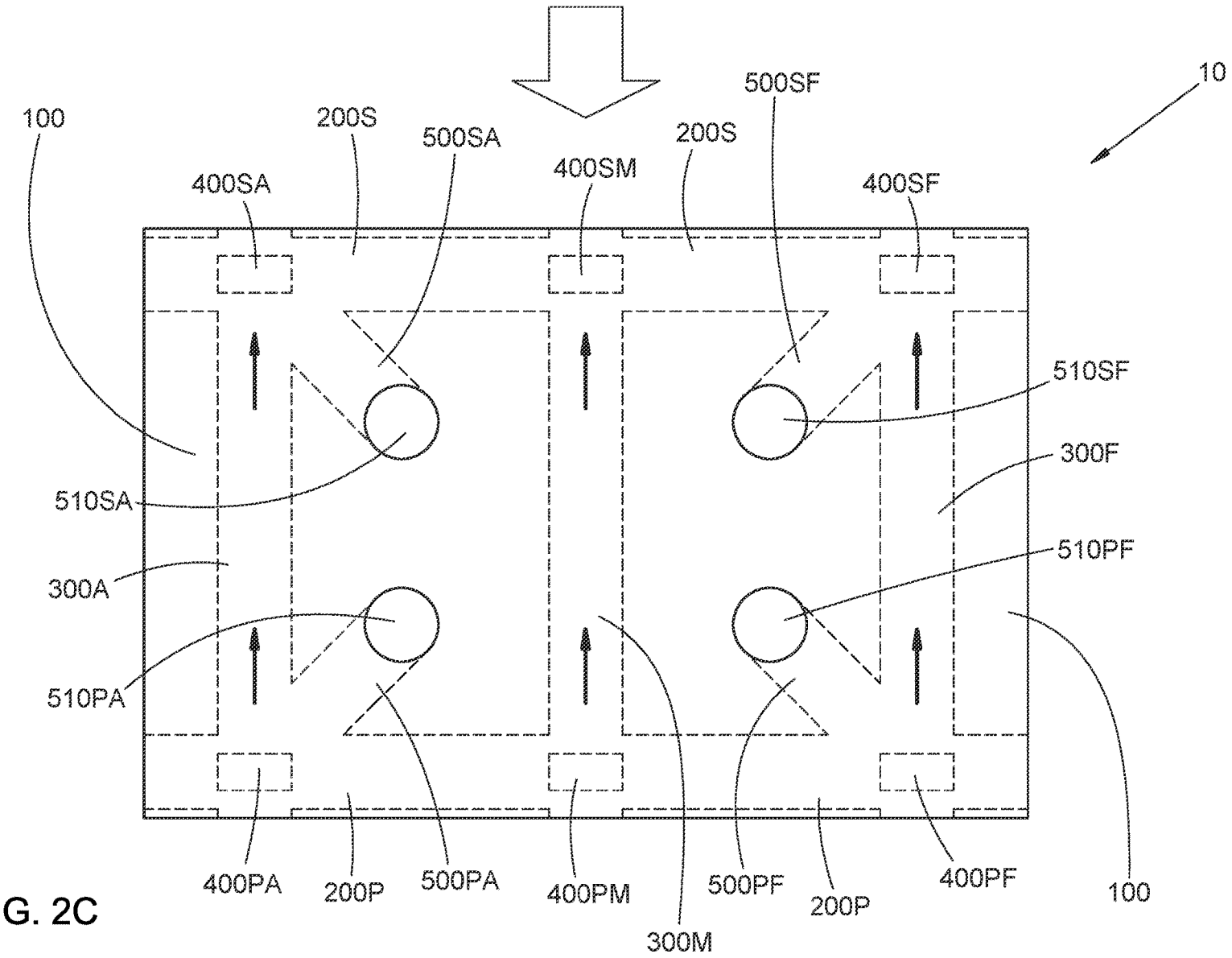
Figure 2D:
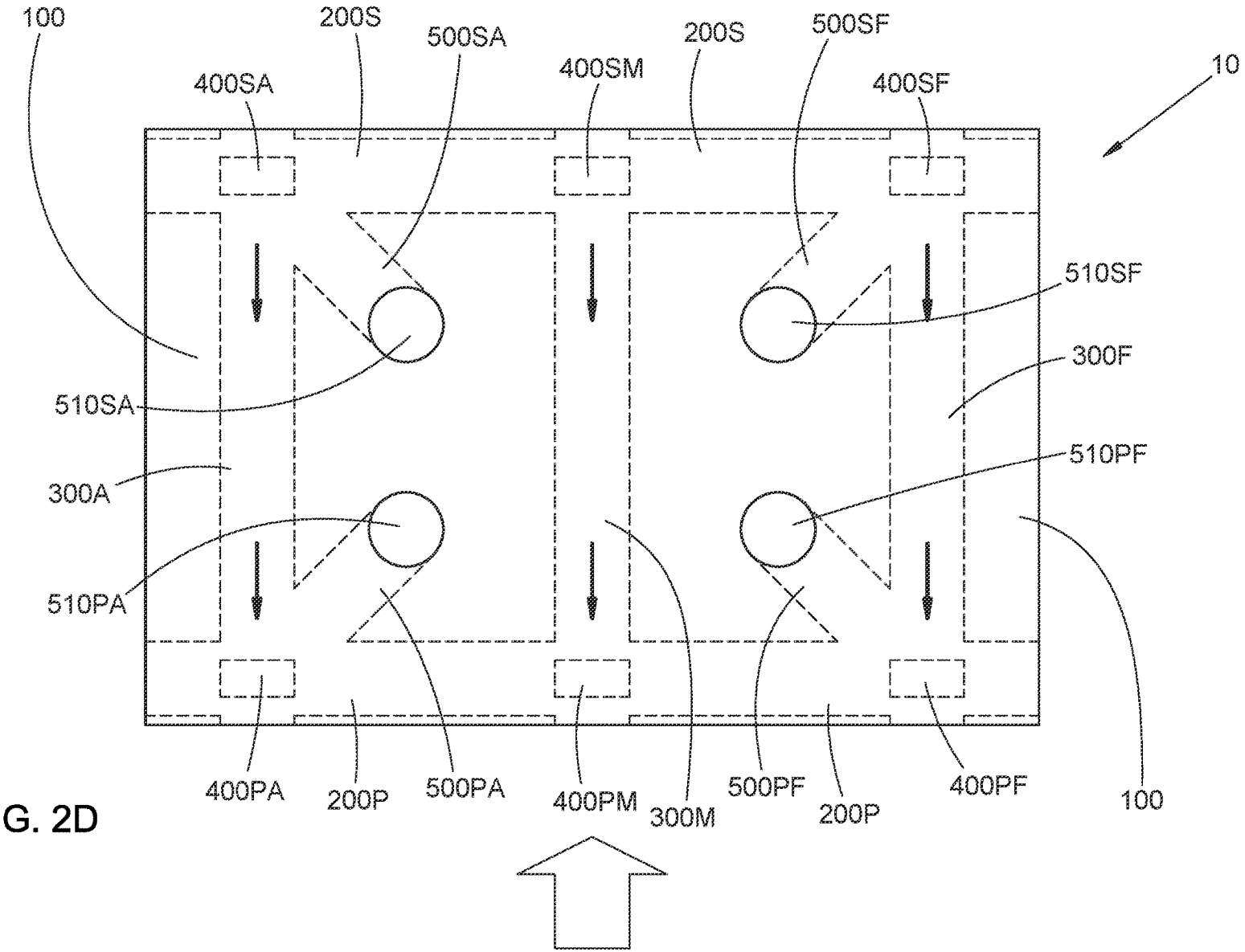

Each thruster 400 is arranged for driving water flow (indicated by heavy black arrows in FIG. 2A through 2E) through the corresponding drive tunnels 200/300 and is rotatable about a corresponding vertical axis among different thruster orientations. Those orientations include (i) a first thruster orientation in which the thruster 400 drives water flow in one direction through the longitudinal drive tunnel 200 (e.g., as in FIG. 2A), (ii) a second thruster orientation in which the thruster 400 drives water flow in an opposite direction through the longitudinal drive tunnel 200 (e.g., as in FIG. 2B), (iii) a third thruster orientation in which the thruster 400 drives water flow in one direction through the transverse drive tunnel 300 (e.g., as in FIG. 2C), or (iv) a fourth thruster orientation in which the thruster 400 drives water flow in an opposite direction through the transverse drive tunnel 300 (e.g., as in FIG. 2D). In FIG. 2A, the thrusters 400 are oriented to drive water in the aft direction through the longitudinal drive tunnels 200 to create forward thrust and drive the vessel 10 in the forward direction (indicated by the large hollow arrow); in FIG. 2B, the thrusters 400 are oriented to drive water in the forward direction through the longitudinal drive tunnels 200 to create aft thrust and drive the vessel 10 in the aft direction; in FIG. 2C, the thrusters 400 are oriented to drive water in the starboard direction through the transverse drive tunnels 300 to create port thrust and drive the vessel 10 in the port direction; in FIG. 2D, the thrusters 400 are oriented to drive water in the port direction through the transverse drive tunnels 300 to create starboard thrust and drive the vessel 10 in the starboard direction.

Figure 2E:
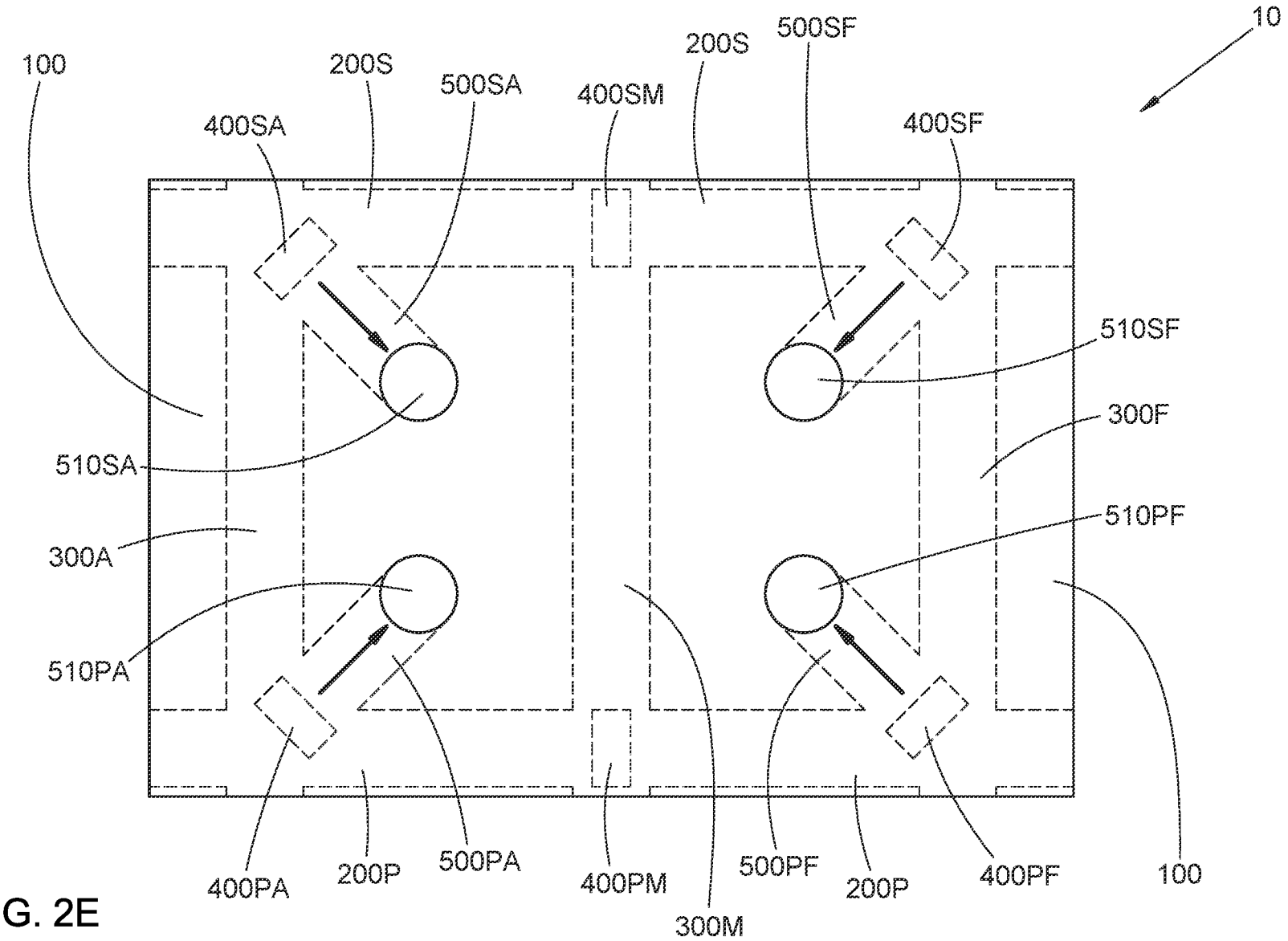

In some examples (including the example shown in FIGS. 1A-1F and 2A-2E), the waterborne vessel 10 can include one or more oblique drive tunnels 500 formed within the base portion 102 of the hull structure 100. Each oblique drive tunnel 500 extends horizontally from a corresponding intersection of longitudinal and transverse drive tunnels 200/300 and terminates at a corresponding opening 510 on a bottom surface of the hull structure 100 (e.g., oblique drive tunnel 500PF and opening 510PF, oblique drive tunnel 500SA and opening 510SA, and so on; referred to collectively or generally as oblique drive tunnels 500 and openings 510). The corresponding thrusters 400 at those intersections are rotatable to a fifth thruster orientation in which those thrusters 400 drive water through the corresponding oblique drive tunnels 500 and out through the corresponding opening 510 at the bottom surface of the hull structure 100. In the example shown, oblique drive tunnels 500 are shown extending inboard at about a 45° angle from port forward, port aft, starboard forward, and starboard aft intersections of the longitudinal and transverse drive tunnels 200/300. In FIG. 2E, the corresponding thrusters 400 are oriented to drive water through the corresponding oblique drive tunnels 500 and out through the corresponding openings 510 at the bottom surface of the hull structure 100 to generate upward thrust on the vessel 10. Such upward thrust can assist in raising the vessel 10 though the water column within a body of water (discussed below).

In some examples the hull structure 100 of the waterborne vessel 10 can include vertical columns 110 extending upward within or adjacent the side walls 104 (e.g., as in FIGS. 1A-1D, 4A, and 4B). Each vertical column can be referred to specifically, e.g., 110PF, 110SA, and so on; they can be referred to generally or collectively as vertical columns 110. Typically each vertical column 110 can be positioned over a corresponding intersection of longitudinal and transverse drive tunnels 200/300, and can house equipment or machinery associated with the thruster 400 located at that intersection. Such equipment or machinery can include, e.g., a motor for driving the thruster 400, a rotary actuator for orienting the thruster 400 about its vertical axis, a linear actuator for raising or lowering the thruster 400 (discussed below), or control or sensing equipment. In the examples shown six vertical columns 110 are positioned above the six corresponding intersections between longitudinal and transverse drive tunnels 200/300; other suitable numbers or positions of vertical columns 110 can be employed, including some examples in which one or more of the columns 110 are not positioned over an intersection of drive tunnels 200/300. In some examples the vessel 10 can include multiple lifting anchors 120, each attached to a corresponding vertical column 110. The lifting anchors 120 can be of any suitable type or arrangement that enables attachment to the hull structure 100 of a lifting harness, a lifting carriage or cradle, or lifting cables. In the example shown the lifting anchors 120 are arranged as lifting eyes that can receive therethrough a cable, hook, clevis, pin, or other attachment hardware. Attachment of cables or other lifting hardware (e.g., lifting carriage or lifting cradle) to the vertical columns 110 (or to other locations on the hull 100) can enable surface vessels (e.g., tugboats or a heavy-lift vessel) to assist in raising the vessel 10 though the water column within a body of water (e.g., by retracting the cables attached directly to the hull 100, or by retracting cables or drill pipe attached to the hull via a carriage or cradle; discussed below).

Figure 3A:
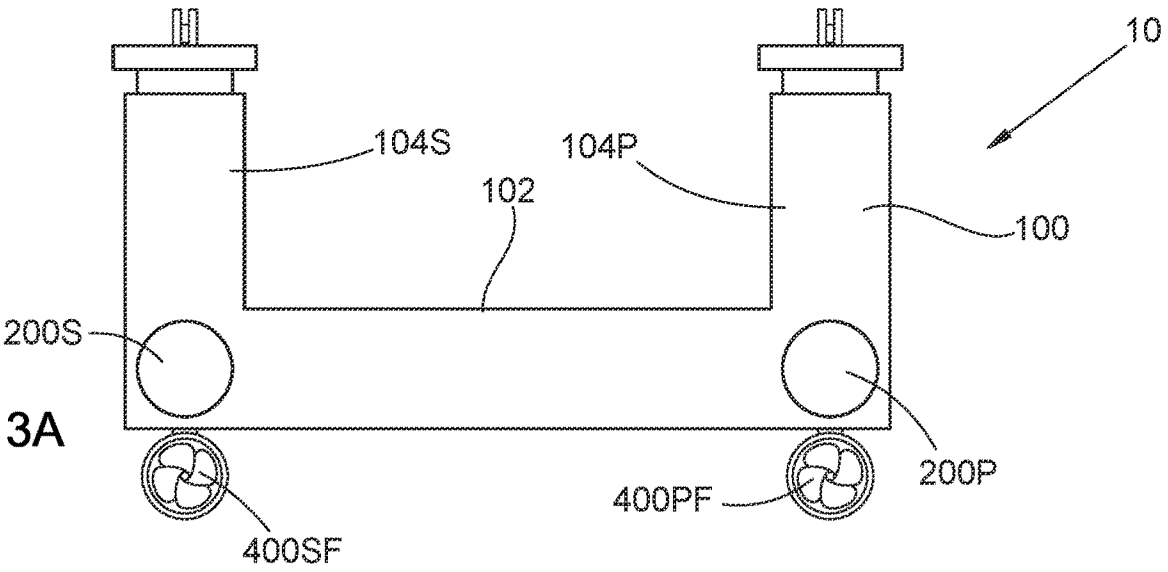
FIGS. 3A and 3B are schematic front and left side views, respectively, of an example waterborne vessel with thrusters deployed below the hull structure.
Figure 3B:
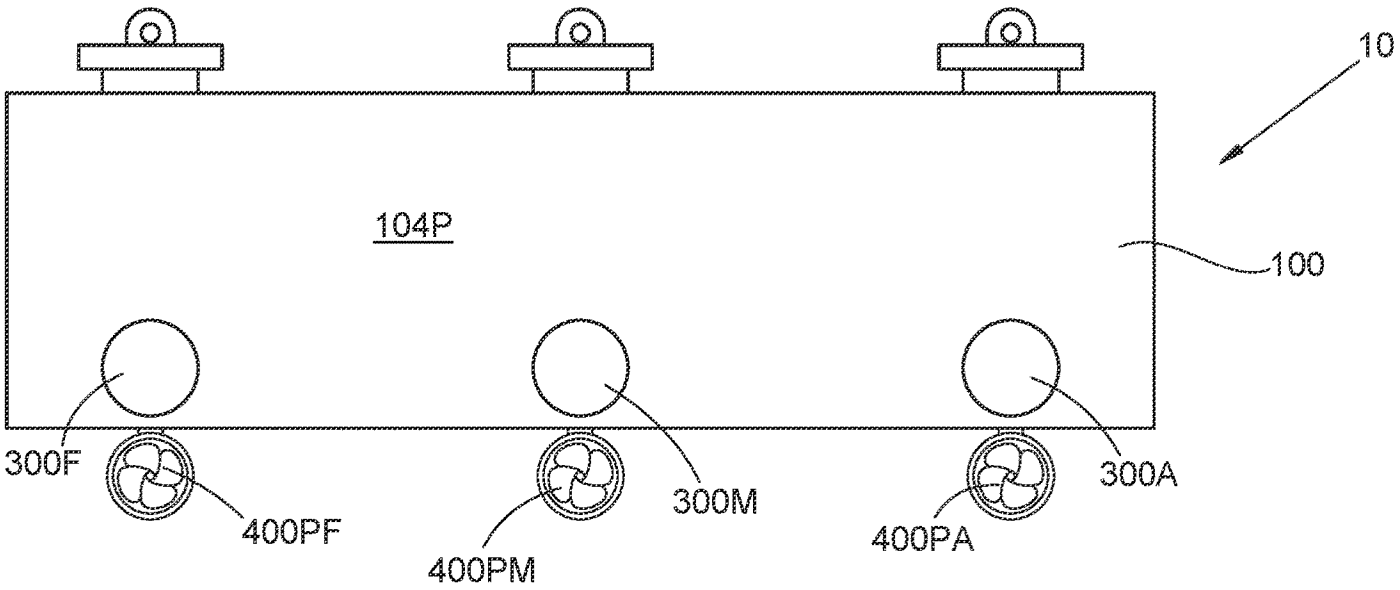

In some examples one or more or all of the thrusters 400 can be movable from within the corresponding drive tunnels 200/300 (e.g., as in FIGS. 1B-1E and 2A-2E) to a lowered position below the bottom surface of the hull structure 100 (e.g., as in FIGS. 3A and 3B). In that lowered position, each thruster 400 can provide thrust in any direction by suitable orientation of that thruster 400 about its vertical axis. The thrusters 400 can be used in their lowered positions for precision maneuvering or for station-keeping. The thrusters 400 can be retracted back into the drive tunnels 200/300; in their retracted positions the thrusters 400 can provide longitudinal, transverse, or downward thrust by driving water through the drive tunnels 200/300 as described above and shown in FIGS. 2A-2E. In some examples, doors or hatches can be provided on the bottom of the hull 100 that can be opened to enable lowering and raising of the thrusters 400, or closed when the thrusters 400 are raised to positions within the tunnels 200/300.

Figure 4A:
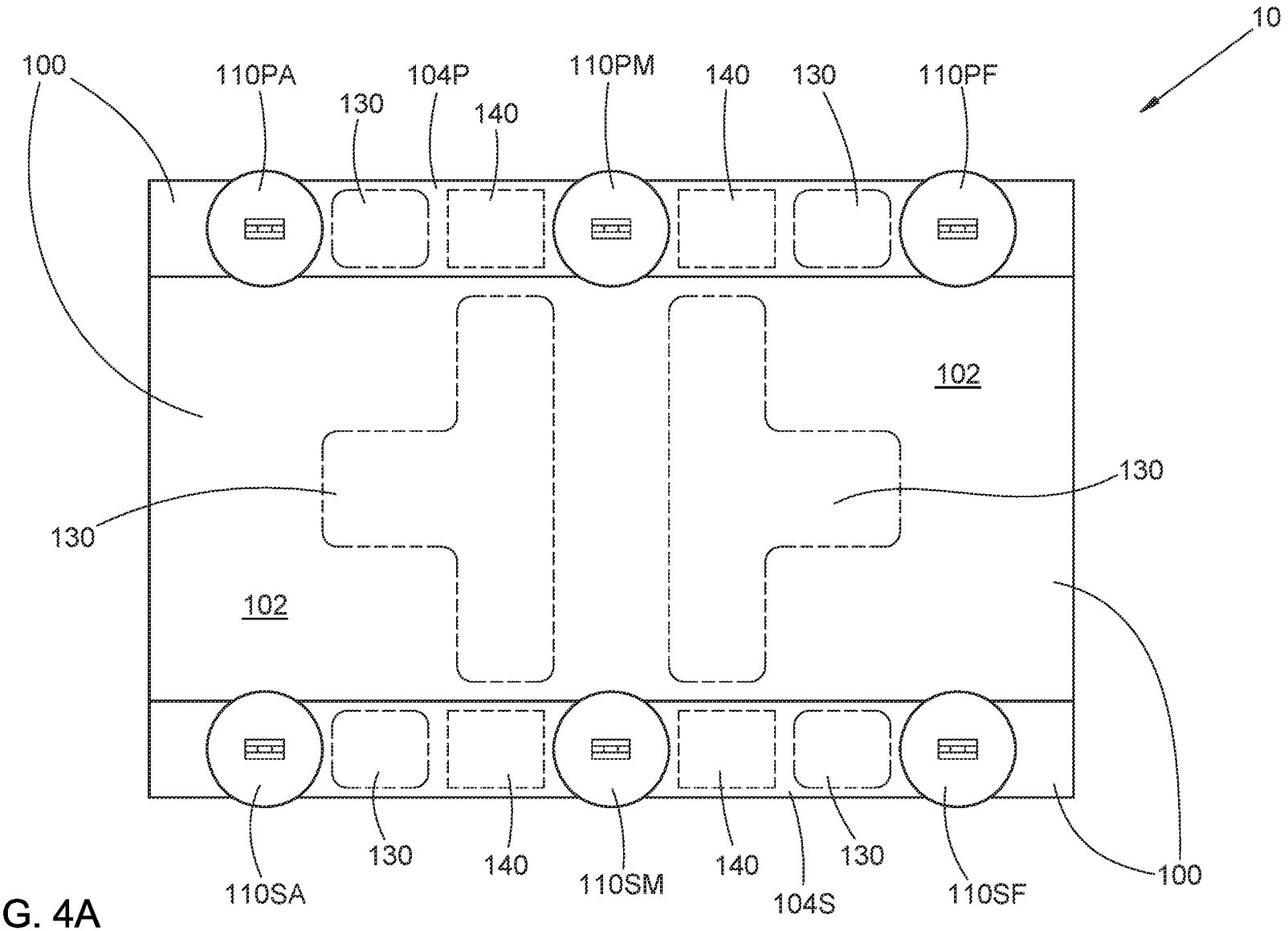
FIGS. 4A and 4B are schematic top and right side views, respectively, of an example waterborne vessel showing batteries, ballast tanks, and internal structures of the towers using dashed lines.
Figure 4B:
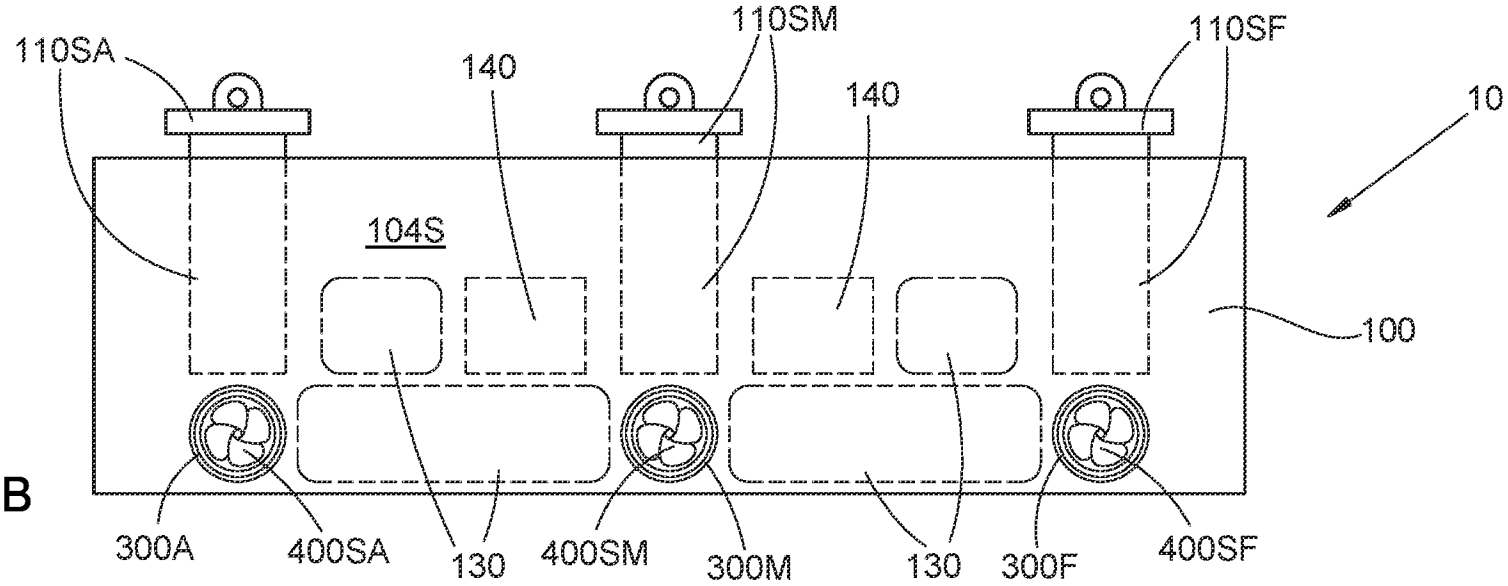

In some examples the waterborne vessel 10 can include one or more ballast tanks 130 positioned on or within the hull structure 100 (e.g., as in FIGS. 4A and 4B). Such ballast tanks 130 can be arranged to provide the waterborne vessel 10 with variable buoyancy, e.g., negative buoyancy for submerging or moving downward through the water column, neutral buoyancy for remaining at a desired depth, or positive buoyancy for moving upward through the water column or surfacing. The vessel 10 can include compressed air tanks, pumps, valves, or other equipment for filling or emptying the ballast tanks 130. To raise the vessel 10 through the water column, one or some or all of the following can be used, alone or together: (i) positive buoyancy provided by ballast tanks 130, (ii) upward thrust provided by driving water through the oblique drive tunnels 500 and out through the bottom openings 510, or (iii) lifting force applied by surface vessels via cables or drill pipe attached to the hull structure 100.

Figure 5A:
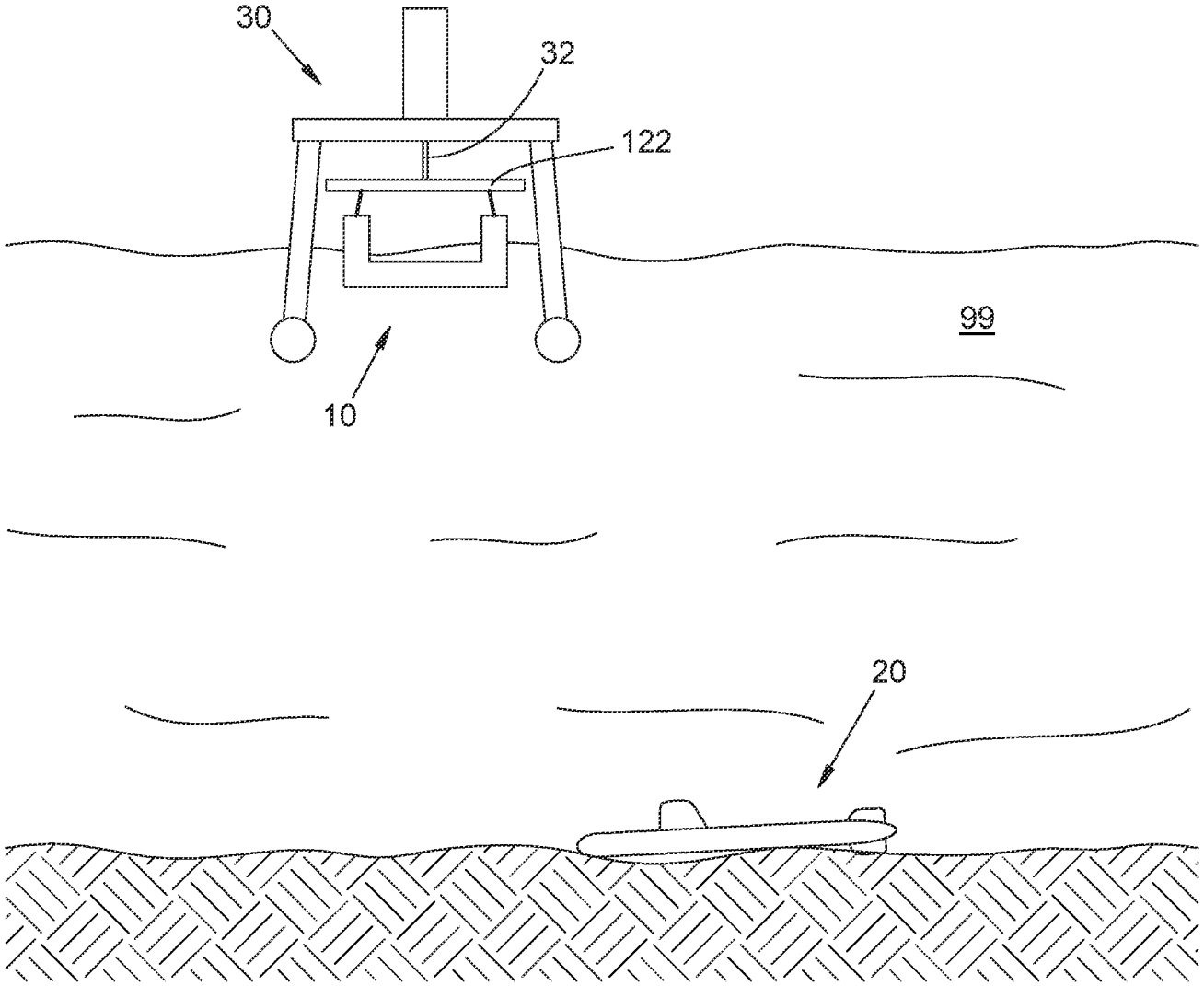
FIGS. 5A through 5D illustrate schematically a method for using the waterborne vessel to retrieve a target payload from the bottom of a body of water.
Figure 5B:
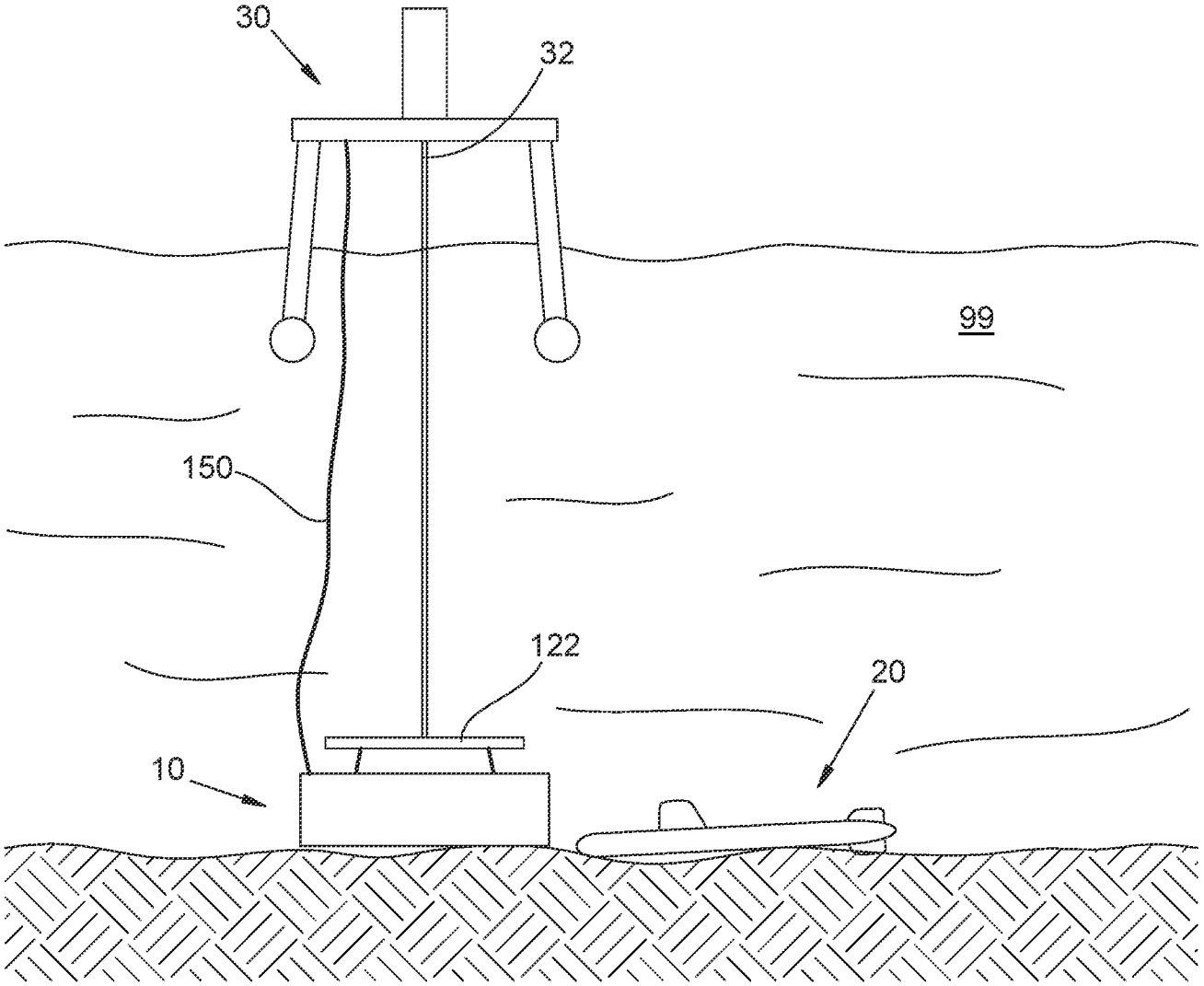
Figure 5C:
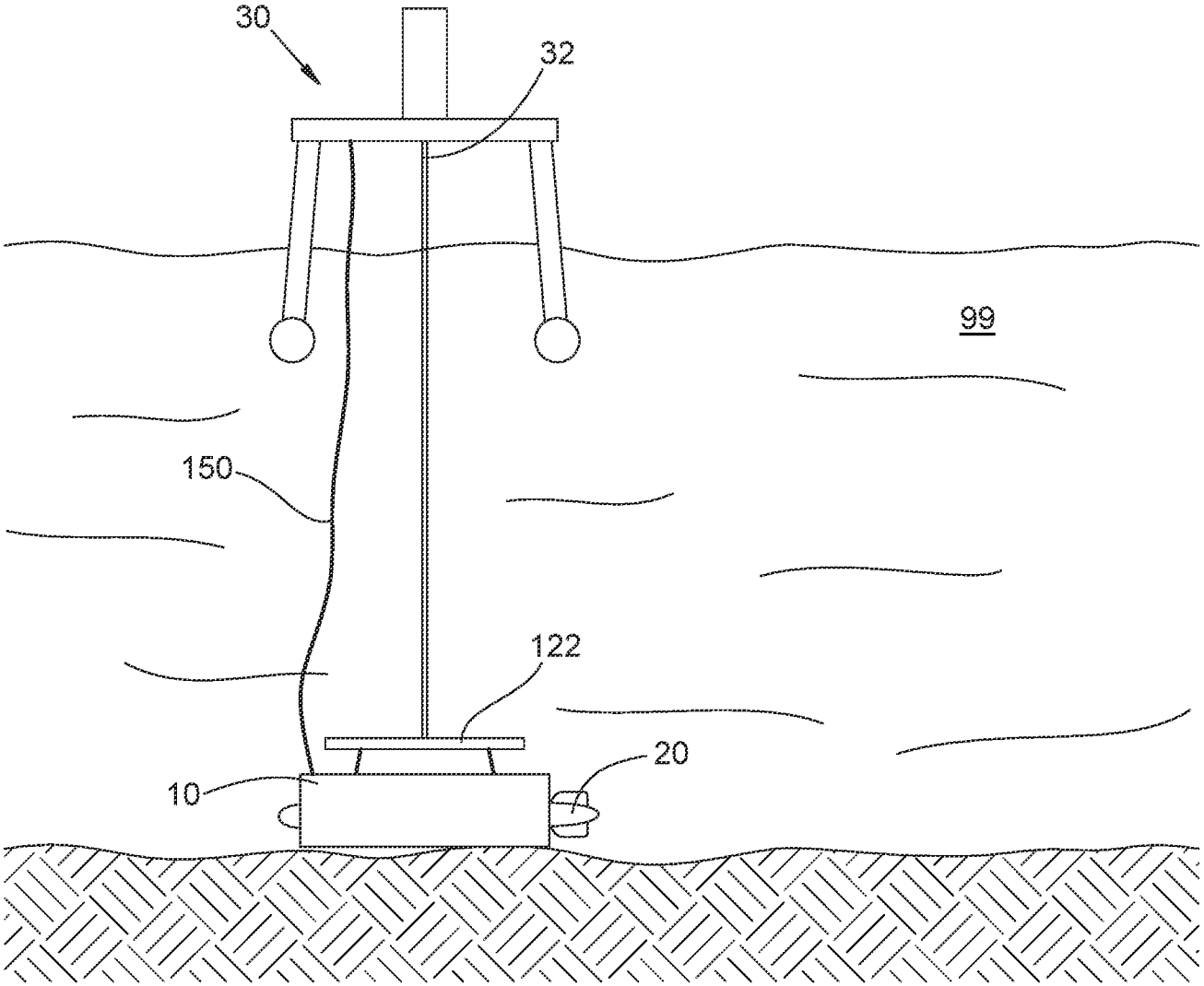
Figure 5D:
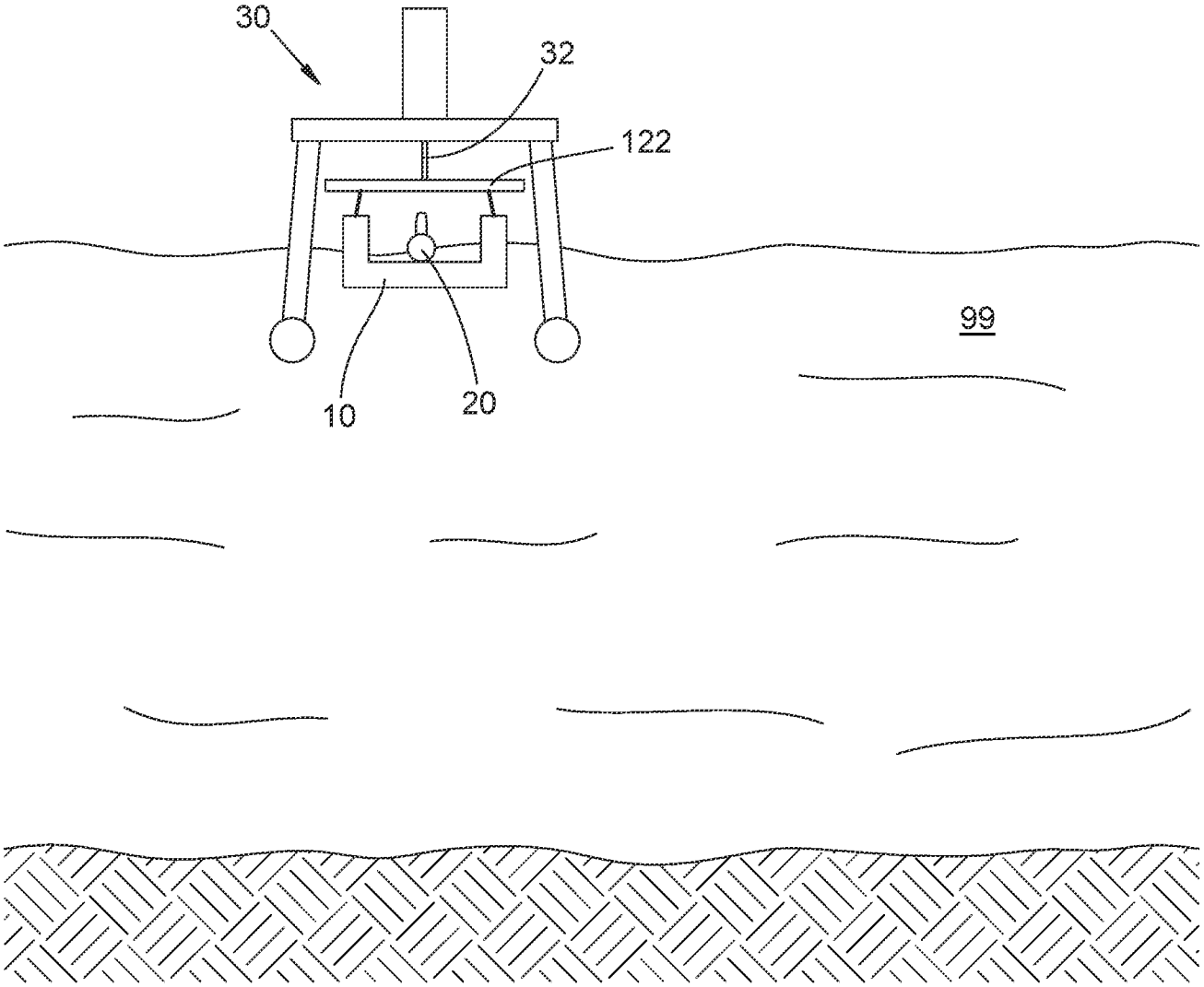
Figure 6A:
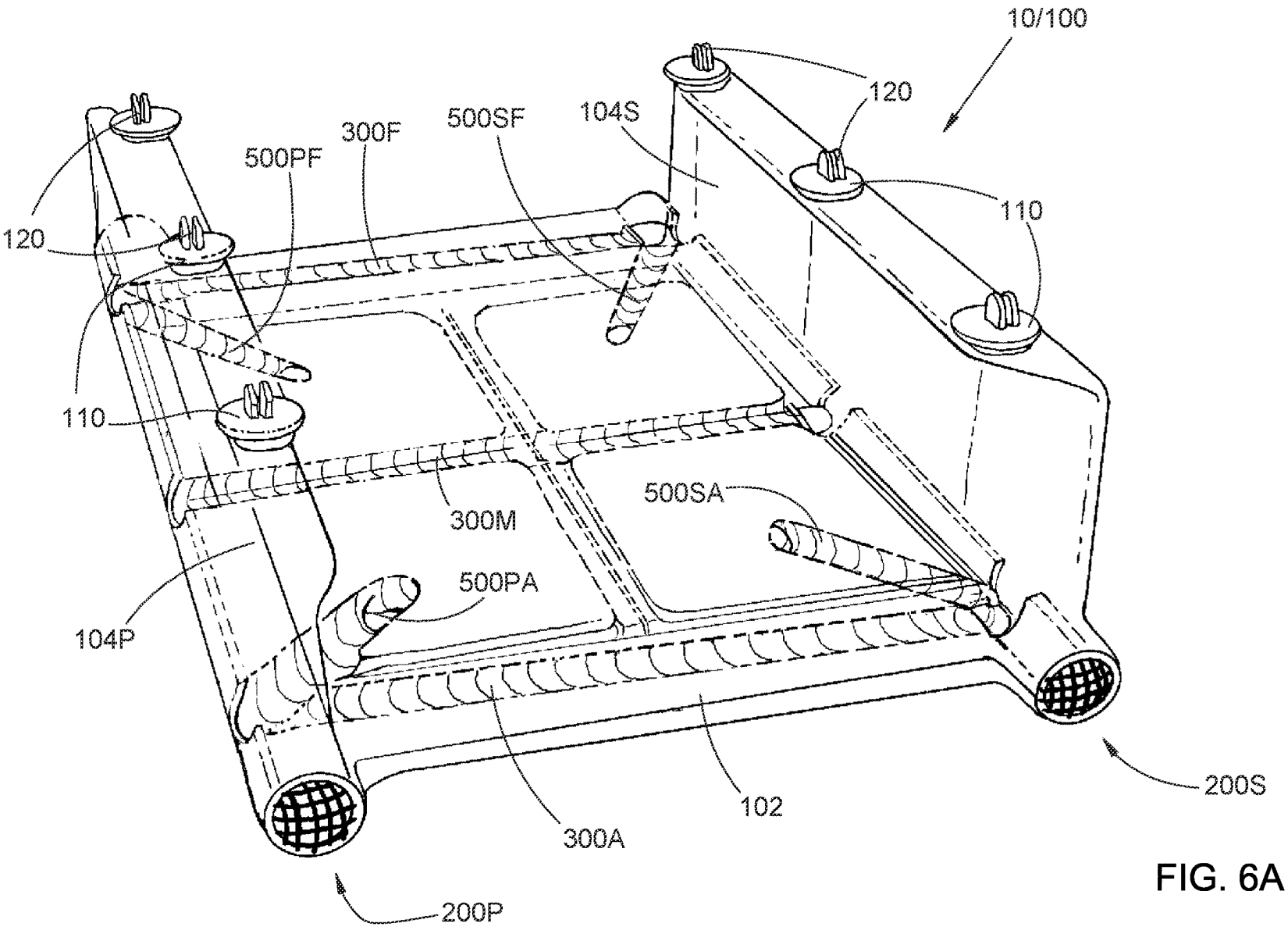
FIGS. 6A through 6E are views of various examples of a waterborne vessel.
Figure 6B:
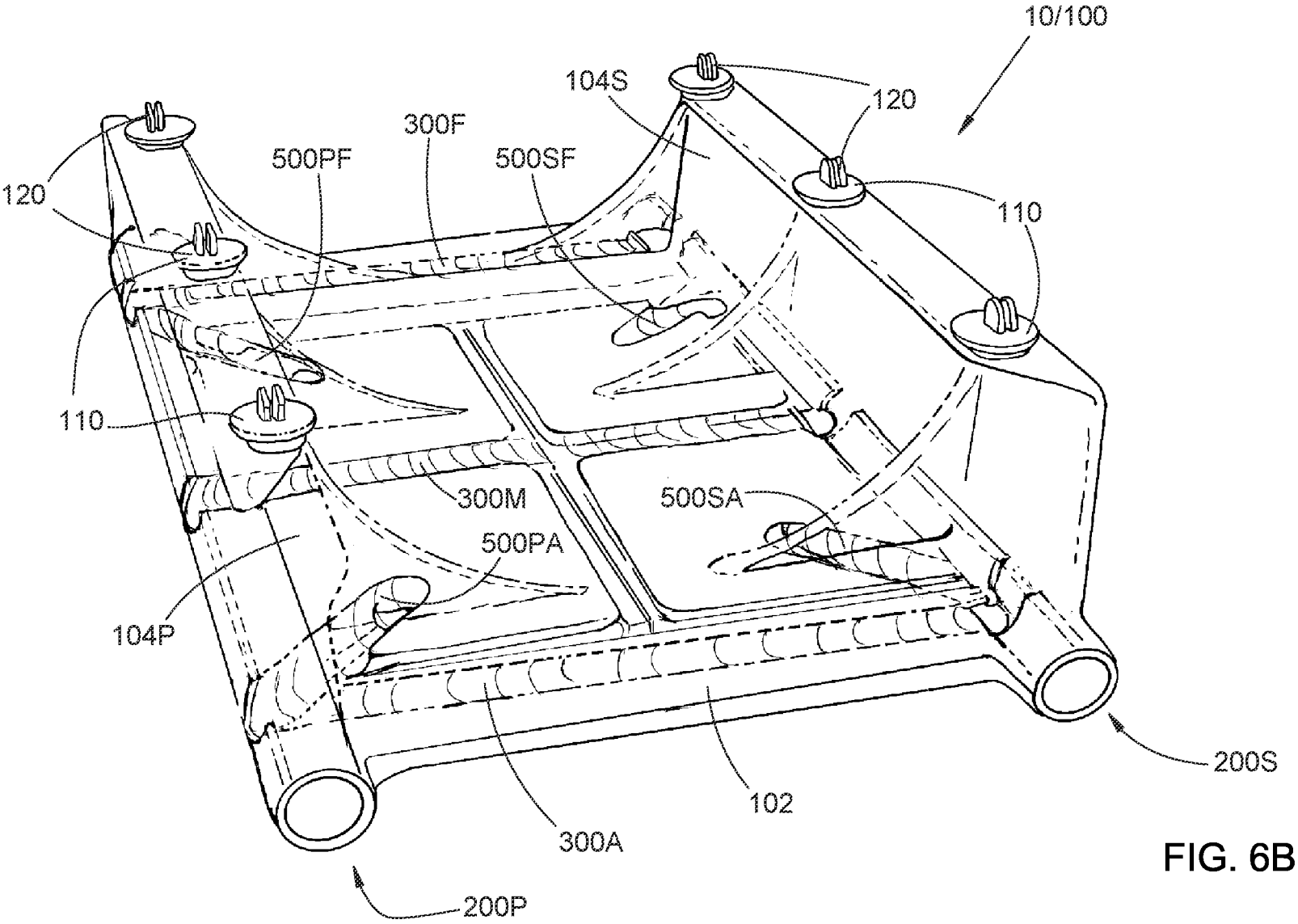
Figure 6C:
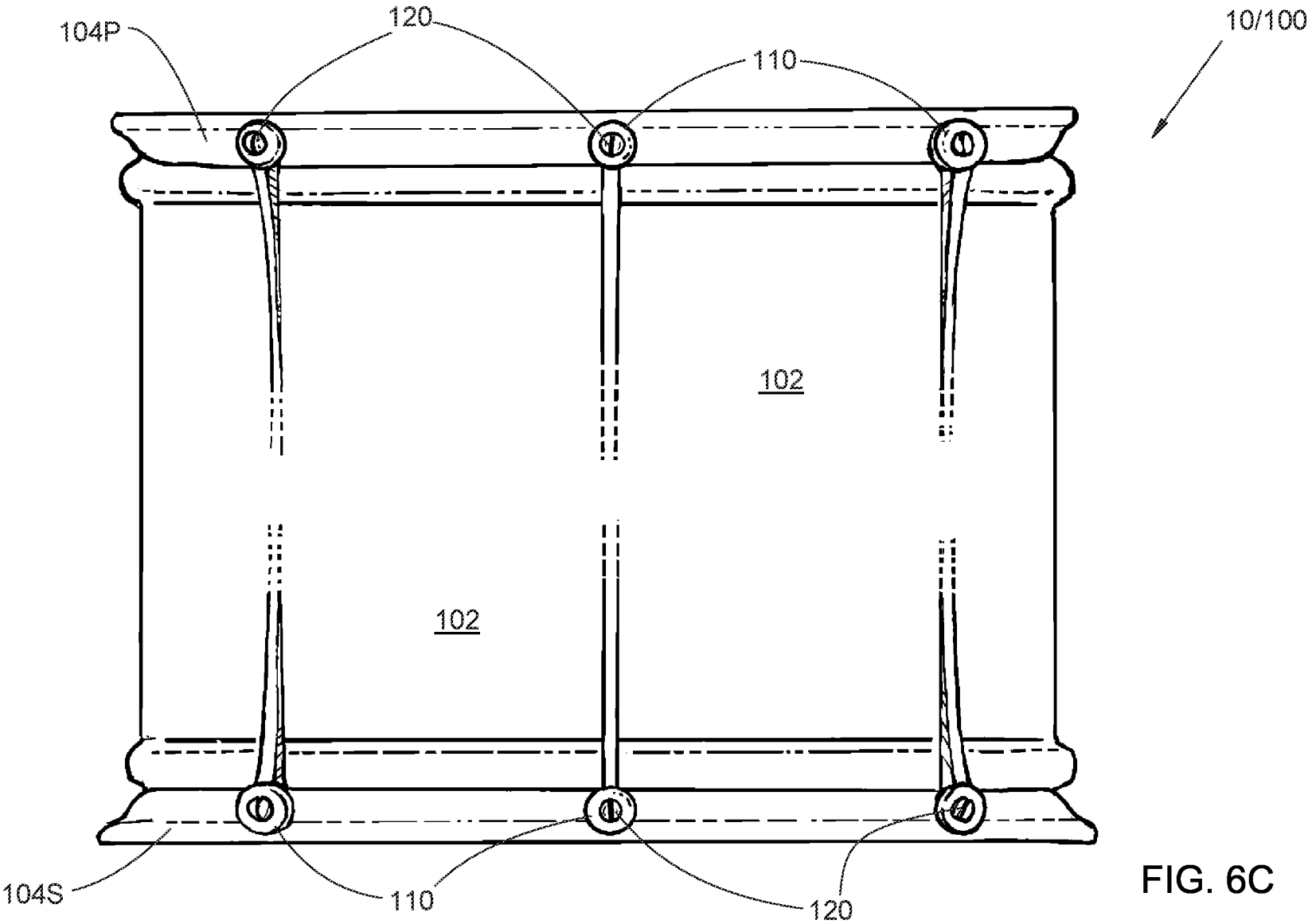
Figure 6D:
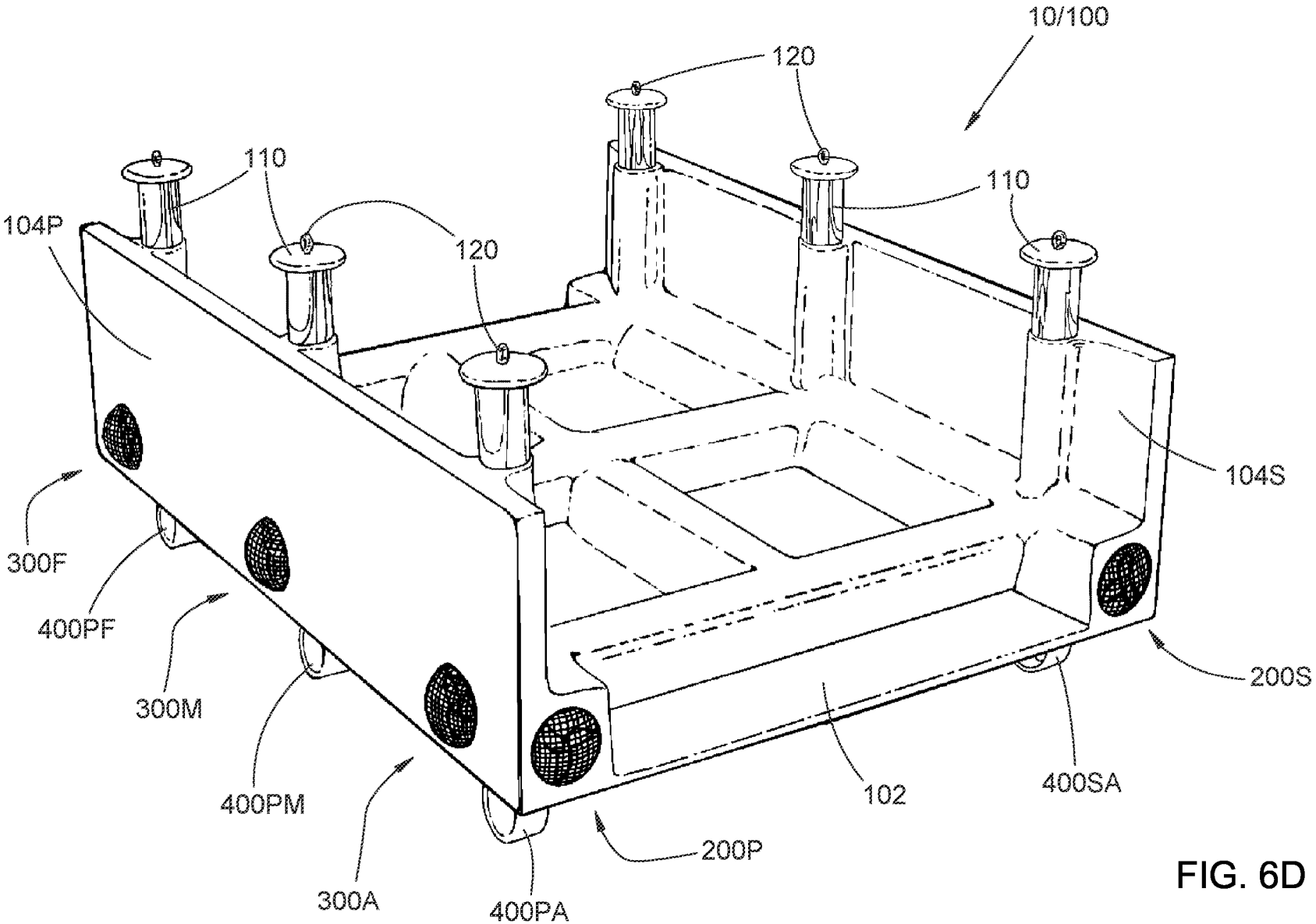
Figure 6E:
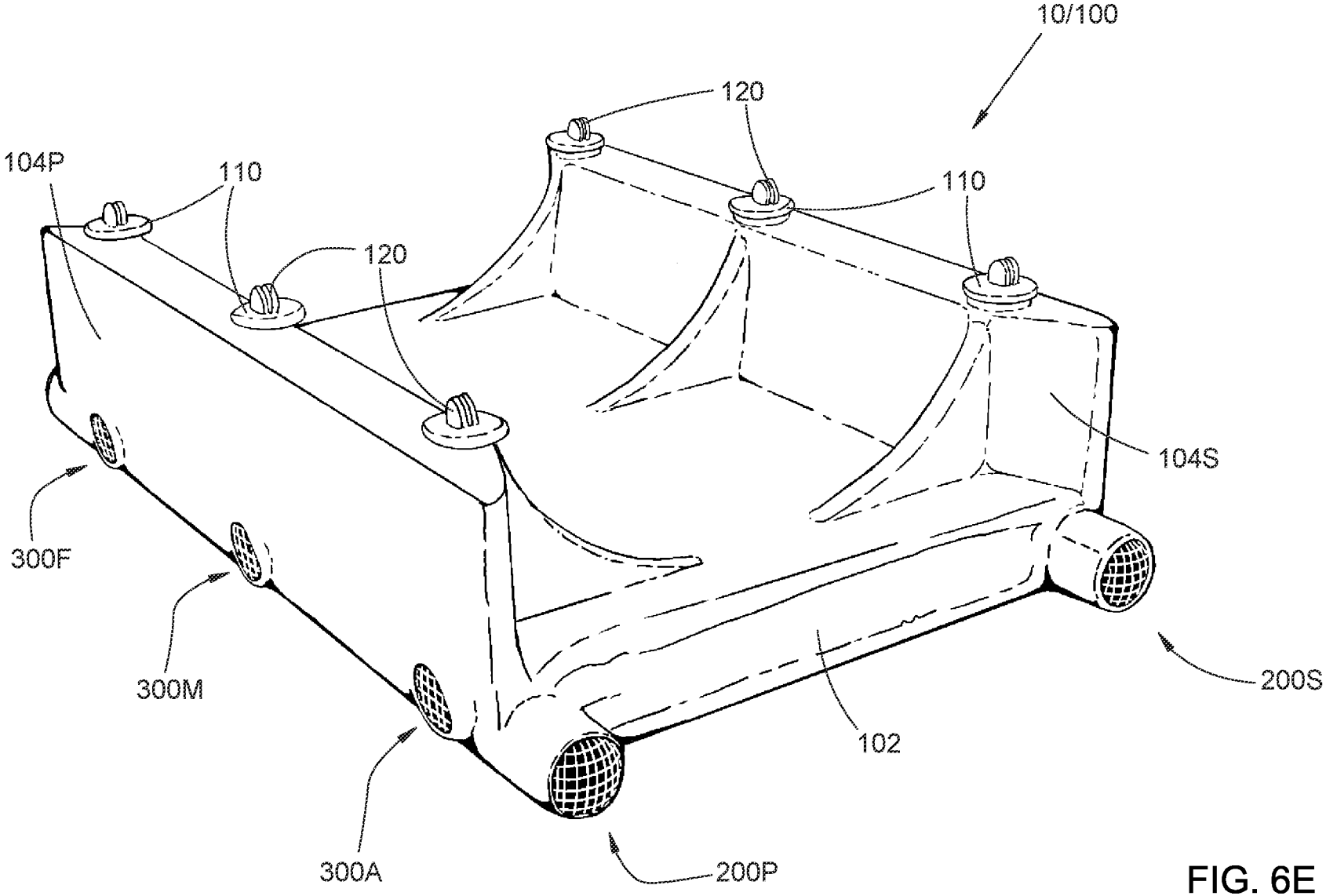
Figure 7A:
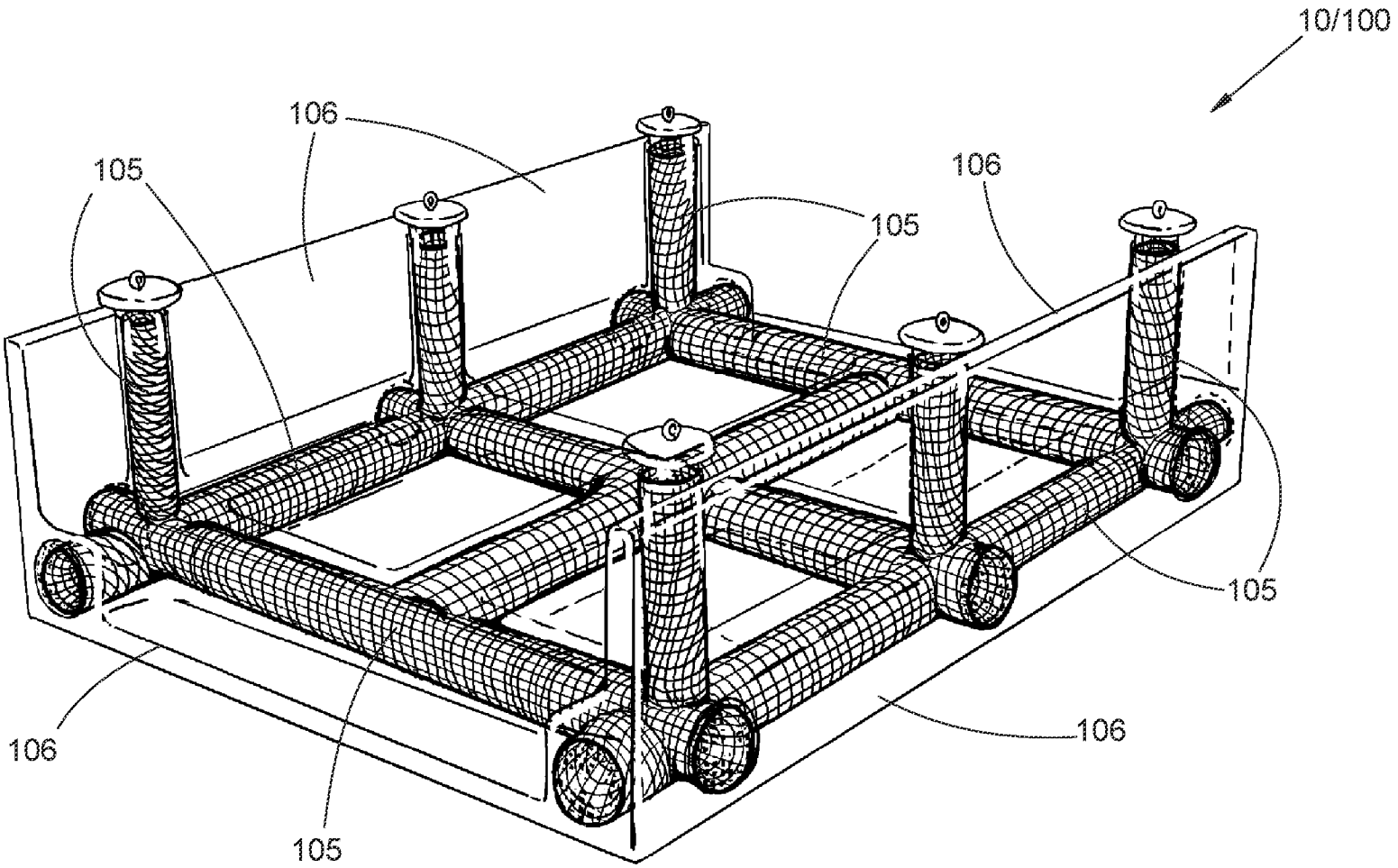
FIGS. 7A through 7E illustrate schematically example arrangements of the frame and the skin of the vessel.
Figures 7B, 7C:
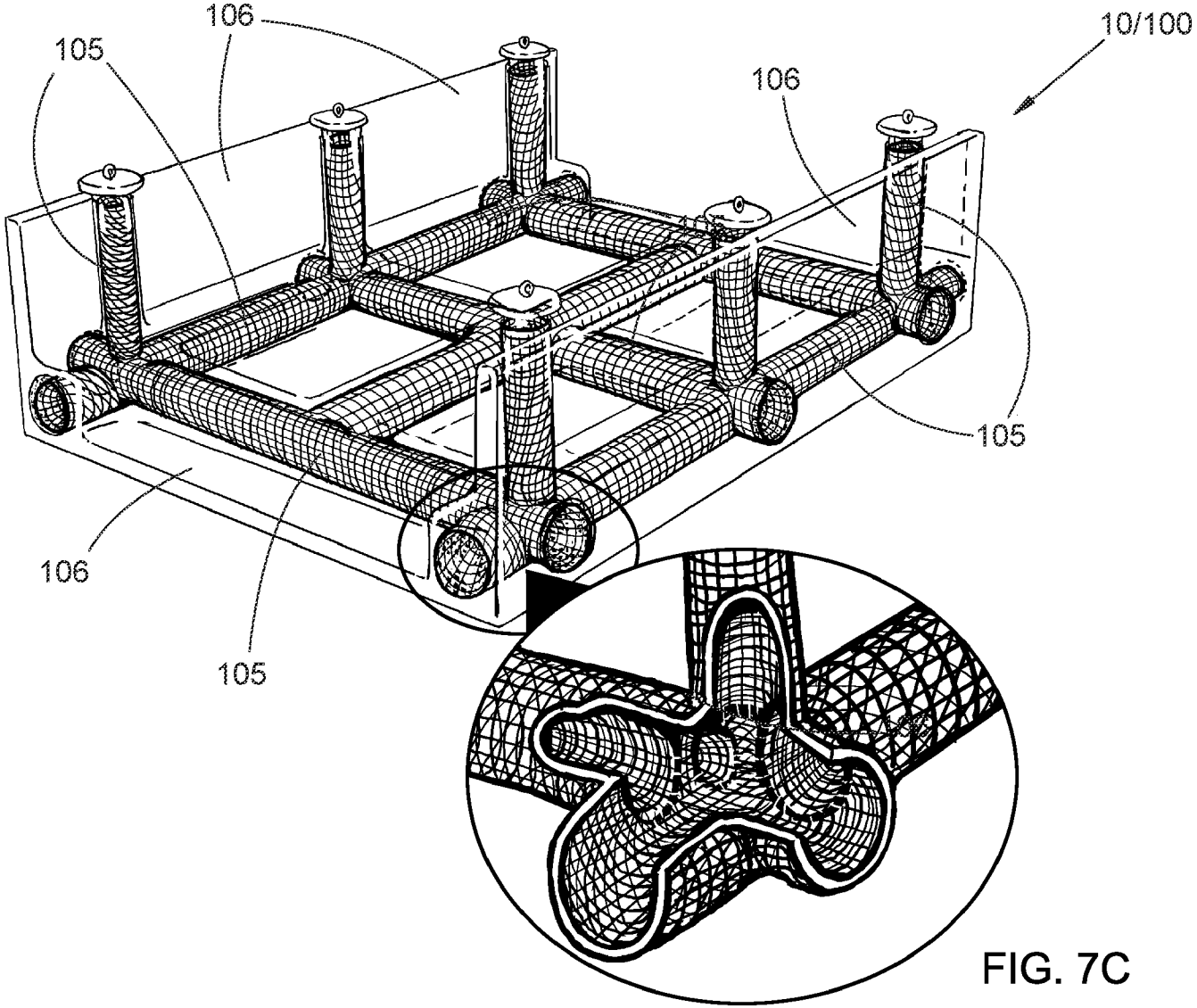
Figures 7D, 7E:
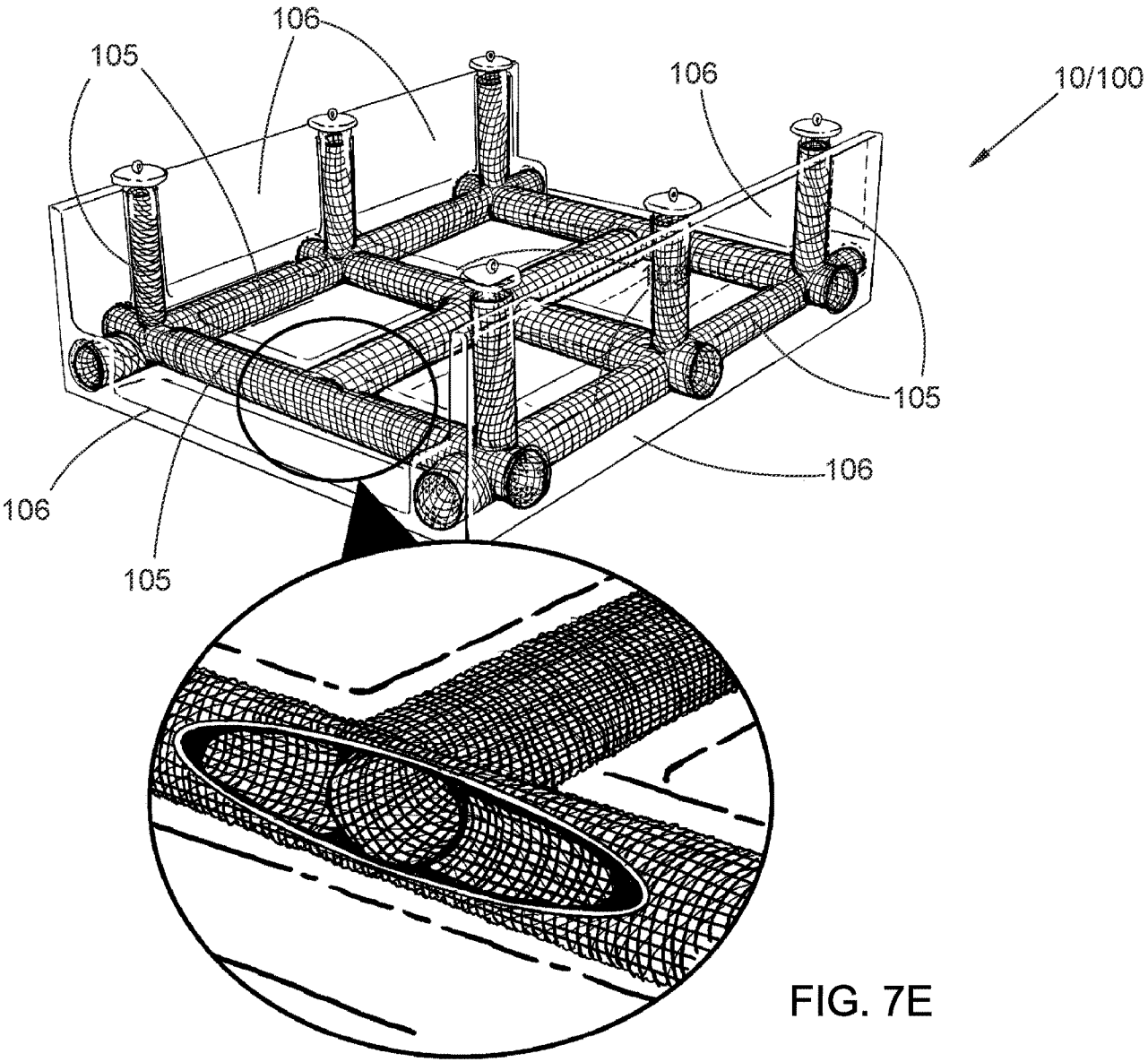

Power for driving the thrusters 400 can be provided in any suitable way. In some examples, the thrusters 400 can be powered electrically. In some electrically powered examples, one or more batteries 140 (e.g., lithium-ion batteries or other suitable battery type) can be positioned on or within the hull structure 100 (e.g., as in FIGS. 4A and 4B) and connected so as to provide power to the one or more thrusters. Instead or in addition, an umbilical 150 can connect the vessel 10 to a surface vessel that provides electrical power through the umbilical 150 (e.g., as in FIGS. 5B and 5C). In examples that include an umbilical 150, the umbilical 150 can be structured to provide, between the waterborne vessel 10 and a surface vessel, one or more of electrical power supplied to the waterborne vessel 10, control signals transmitted to the waterborne vessel 10, sensor signals transmitted from the waterborne vessel 10, or air or gas supplied to the waterborne vessel 10.

The hull structure 100 can be structured and constructed in any suitable way using any one or more suitable materials. In some examples the hull structure 100 comprises a framework 105 (e.g., keels, ring frames, bulkheads, stringers, vertical towers) and skin 106 (e.g., outer skin, bulkheads, interior partitions or chambers, engine or battery compartments, or ballast tanks). Various example arrangements are illustrated schematically in the transparent views of FIGS. 7A-7E. In some examples the framework 105 can include one or more metallic materials; examples of suitable metallic materials for the framework can include titanium or a titanium alloy (e.g., 48-0T3V titanium alloy). In some examples the skin 106 can include one or more composite materials; examples of suitable composite materials for the skin 106 can include carbon, glass, or polymer fibers in a polymer resin binder (e.g., epoxies, polyesters, vinylesters, thermoplastics, or thermosets). Any suitable manufacturing technology can be employed, e.g., resin-infusion technology, resin transfer molding, or vacuum-assisted resin transfer molding. Use of such frame or skin materials for constructing the waterborne vessel 10 can be advantageous due to, e.g., strength, relatively lighter weight, or resistance to galvanic corrosion, electrolysis, or oxidation.

Figures 8A, 8B:
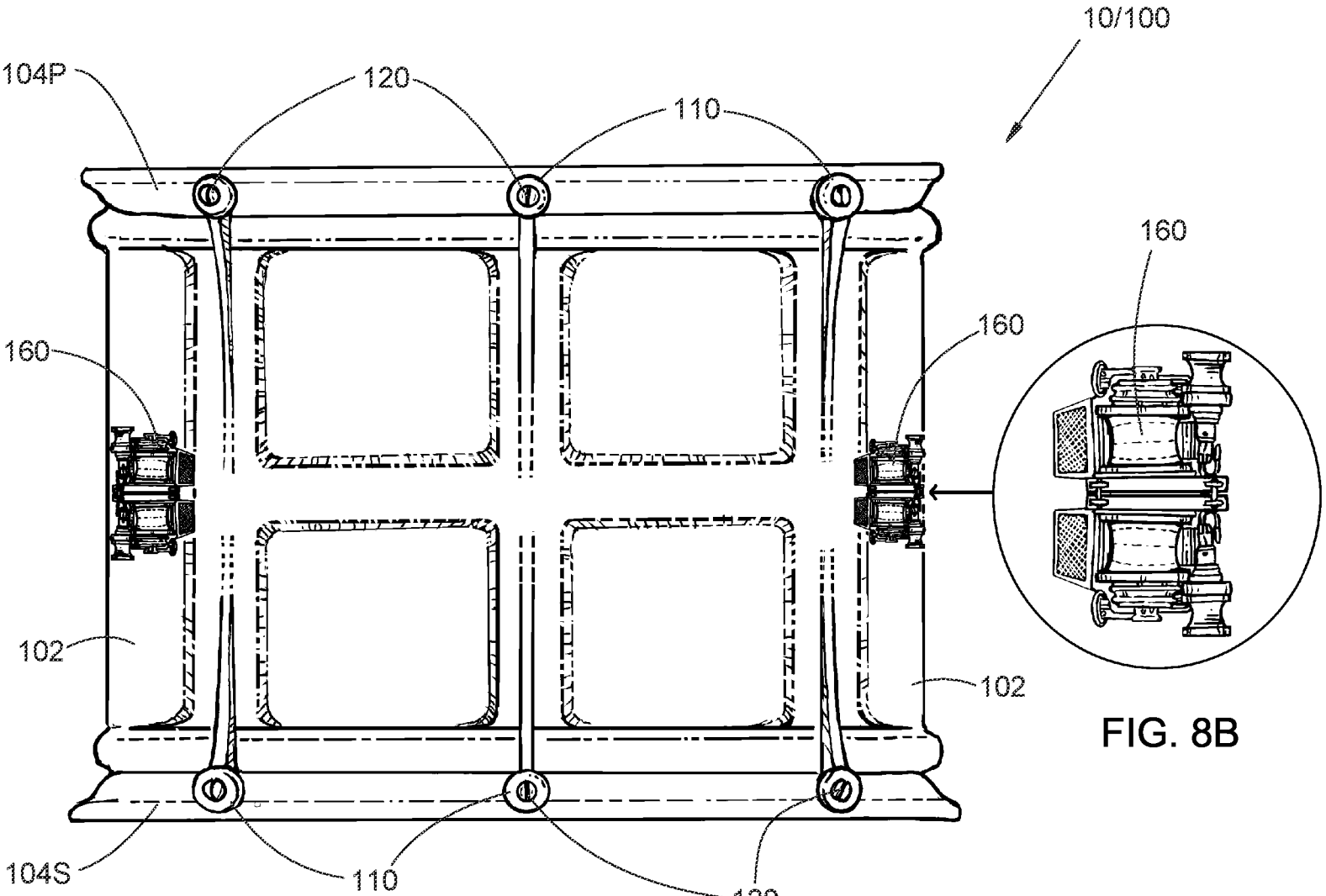
FIGS. 8A and 8B illustrate schematically a pair of winches on the vessel.

An important use of the inventive waterborne vessel 10 is retrieval or recovery of underwater objects, e.g., sunken ships, submarines, or aircraft, planes, damaged or decommissioned drilling or well rigs, or other large or unwieldy objects. To that end, in some examples the waterborne vessel 10 can include one or more winches 160 arranged for pulling a payload onto the base portion 102 through the open forward end or through the open aft end; the example shown in FIGS. 8A and 8B includes one winch 160 at each end of the vessel 10; other numbers or arrangements of winches 160 can be employed, or different equipment for moving a payload onto the vessel can be employed. The vessel 10 can be of a size suitable for retrieving and carrying the target object or payload. A smaller vessel 10 can be employed for recovering only smaller payloads, while a larger vessel 10 can be employed for recovering larger payloads. In some examples, the vessel 10 can be more than 50 feet long, more than 100 feet long, more than 200 feet long, more than 300 feet long, or more than 500 feet long. In some examples the vessel 10 can be more than 30 feet wide, more than 50 feet wide, more than 100 feet wide, more than 200 feet wide, or more than 300 feet wide. In some examples the vessel 10 can be more than 20 feet high, more than 50 feet high, more than 100 feet high, more than 200 feet high, or more than 300 feet high. In one specific example, the vessel 10 can be 350 feet long, 120 feet wide, and 155 feet high.

A method employing the waterborne vessel 10 is illustrated schematically in FIGS. 5A through 5D and includes (A) lowering the waterborne vessel 10 into a body of water 99 to a position adjacent a submerged target payload 20; (B) maneuvering one or both of the waterborne vessel 10 or the target payload 20 to position the target payload on the base portion 102 of the hull structure 100 between the side walls 104; and (C) raising the waterborne vessel 10 toward a surface of the body of water 99 with the target payload 20 on the base portion 102 of the hull structure 100 between the side walls 104. In the example shown the target payload is a sunken submarine 20 on the seabed (i.e., on the bottom surface of the body of water 99). When the target payload rests on the bottom surface of the body of water 99, the waterborne vessel 10 can be lowered to rest on the bottom surface of the body of water 99 adjacent the target payload 20.

The vessel 10 can be submerged and/or lowered through the water column by negative buoyancy, which can be achieved in some examples by filling the ballast tanks 130. In some examples the vessel 10 can be attached to one or more surface vessels (e.g., by cables attached to the vessel 10, e.g., to the lifting anchors 120 (in some cases using a cradle or carriage); in such examples lowering the vessel 10 through the water column can include letting out the cables to allow the vessel 10 to sink through the water. In some examples the vessel 10 can be attached to a heavy lifting vessel 30, e.g., by cables or drill pipe 32 attached to the vessel 10, e.g., to the lifting anchors 120 (in some cases using a cradle or carriage 122); in such examples lowering the vessel through the water column can include letting out the cables (e.g., from winches) or lowering the drill pipe 32 (e.g., using a lifting derrick with traveling blocks) to allow the vessel 10 to sink through the water. The heavy-lift vessel 30 can be of any suitable type or arrangement; one example of a suitable heavy-lift vessel 30 is disclosed in U.S. Pat. No. 9,446,825, which is incorporated by reference as if set forth herein in its entirety.

As the vessel 10 is lowered through the water, or when the vessel 10 reaches a depth near that of the submerged target payload 20, the thrusters 400 can be employed to maneuver the vessel 10 into a desired position and orientation relative to the submerged payload 20. In some examples the thrusters 400 can be operated within the drive tunnels 200 or 300 to generate forward, aft, port, or starboard movement of the vessel 10, as described above (e.g., as in FIGS. 2A-2D). In other examples the thrusters 400 can be lowered to positions below the base portion 102 (e.g., as in FIG. 3A or 3B), rotated about their respective vertical axes to desired orientations, and operated for precision maneuvering (including translation or rotation) or for station-keeping.

Once the vessel 10 is suitably positioned and oriented relative to the submerged target payload 20, the payload can be maneuvered between the vertical side walls 104 and onto the base portion 102. In some examples, winches 160 can be employed to pull the target payload 20 into the vessel 10, through the open front end or the open aft end, onto the bottom portion 102 of the hull 100 between the vertical side walls 104. Other suitable mechanisms, apparatus, or machinery can be employed to move the target payload 20 into the vessel 10.

Once the target payload 20 is positioned on the vessel 10, they can be raised together toward the surface. Raising the vessel 10 and payload 20 can include one or more of: (i) emptying the ballast tanks 130 to increase buoyancy, (iii) using the thrusters 400 to drive water through the oblique drive tunnels 500 and out of the bottom openings 510 to generate upward thrust, (iii) retracting attached lifting cables into one or more lift vessels (e.g., tugboats or offshore service vessel) or a heavy-lift vessel 30, (iv) retracting attached drill pipe 32 using a heavy-lift vessel 30. As noted above, in some examples lift cables can be attached directly to the hull 100 (e.g., at lifting anchors 120), while in other examples lift cables or drill pipe 32 can be attached to a lift carriage or lifting cradle 122 that is in turn attached to the hull 100 (e.g., at lifting anchors 120).

The vessel 10 and payload 20 can be raised to any desired depth. In some instances it may be desirable to raise the vessel 10 and payload 20 to near the water surface but still submerged below the water surface. In other instances the vessel 10 and payload 20 can be raised so that one or both of the vessel 10 or the target payload are at least partly above the surface of the body of water.

During operation of the waterborne vessel 10, an umbilical 150 can connect the vessel 10 to a surface vessel (e.g., a tugboat, offshore service vessel, or heavy-lift vessel). The umbilical 150 can be employed for one or more of (i) supplying electrical power to the vessel 10, (ii) transmitting control signals to the vessel 10, (iii) transmitting sensor signals from the vessel 10, or (iv) supplying air or gas to the vessel 10.

Before lowering the vessel 10, it often must be moved across at least a portion of the body of water 99, often at or near the water surface, to a location of the submerged target payload 20 (i.e., the recovery location). The vessel 10 can be moved in any suitable way. In some examples the vessel can be towed by one or more of the lift vessels or heavy-lift vessel 30 that are also used for the lowering or raising operations described above. In some examples one or more towing vessels, different from the lifting vessels or heavy-lift vessel, can be used to tow the vessel 10 to the recovery location. In such instances towing cables can be attached to the vessel 10, e.g., at one or more of the lifting anchors 120. After recovering the target payload 20 and raising the vessel to and payload 20, they can be similarly moved away from the recovery location, using the lifting vessel(s) or the heavy-lift vessel used for raising them, or using different towing vessel(s).

In addition to the preceding, the following example embodiments fall within the scope of the present disclosure or appended claims:

Example 1. A waterborne vessel comprising: (a) a hull structure including a horizontal base portion, a port vertical side wall, and a starboard vertical side wall, the side walls being attached to the base portion in a generally longitudinal, transversely spaced-apart arrangement so that the hull structure has a generally U-shaped transverse cross-section, open forward and aft ends, and an open top; (b) one or more longitudinal drive tunnels formed within and extending through the base portion of the hull structure; (c) one or more transverse drive tunnels formed within and extending through the base portion of the hull structure and intersecting each of the one or more longitudinal drive tunnels; and (d) one or more thrusters, each thruster being located within a corresponding one of the one or more longitudinal drive tunnels and a corresponding one of the one or more transverse drive tunnels, at a corresponding intersection thereof, each thruster being arranged for driving water flow through the corresponding drive tunnels and being rotatable about a corresponding vertical axis among (i) a first thruster orientation in which the thruster is arranged to drive water flow in one direction through the longitudinal drive tunnel, (ii) a second thruster orientation in which the thruster is arranged to drive water flow in an opposite direction through the longitudinal drive tunnel, (iii) a third thruster orientation in which the thruster is arranged to drive water flow in one direction through the transverse drive tunnel, or (iv) a fourth thruster orientation in which the thruster is arranged to drive water flow in an opposite direction through the transverse drive tunnel.

Example 2. The waterborne vessel of Example 1 further comprising one or more oblique drive tunnels formed within the base portion of the hull structure, each oblique drive tunnel extending horizontally from a corresponding one of the one or more intersections of longitudinal and transverse drive tunnels and terminating at a corresponding one of one or more openings on a bottom surface of the hull structure, the corresponding thruster at that intersection being rotatable to a fifth thruster orientation in which the thruster is arranged to drive water through the oblique drive tunnel and out through the corresponding opening at the bottom surface of the hull structure.

Example 3. The waterborne vessel of Example 1, wherein: (b') the one or more longitudinal drive tunnels include a port drive tunnel positioned below the port side wall and a starboard drive tunnel positioned below the starboard side wall; (c') the one or more transverse drive tunnels include a forward transverse drive tunnel, a midship transverse drive tunnel, and an aft transverse drive tunnel; and (d') a corresponding one of the one or more thrusters is positioned at each of the intersections of (i) the port and forward drive tunnels, (ii) the port and midship drive tunnels, (iii) the port and aft drive tunnels, (iv) the starboard and forward drive tunnels, (v) the starboard and midship drive tunnels, and (vi) the starboard and aft drive tunnels.

Example 4. The waterborne vessel of Example 3 further comprising four oblique drive tunnels formed within the base portion of the hull structure, each oblique drive tunnel extending inboard from a corresponding one of the intersections of (i) the port and forward drive tunnels, (ii) the port and aft drive tunnels, (iii) the starboard and forward drive tunnels, and (iv) the starboard and aft drive tunnels, each oblique drive tunnel terminating at a corresponding opening at a bottom surface of the base portion, each corresponding thruster being rotatable to a fifth thruster position in which the thruster is arranged to drive water through the corresponding oblique drive tunnel and out through the corresponding opening at the bottom surface of the hull structure.

Example 5. The waterborne vessel of any one of Examples 3 or 4, the hull structure including vertical columns extending upward within or adjacent the side walls, a corresponding one of the vertical columns being positioned over each one of the intersections of (i) the port and forward drive tunnels, (ii) the port and midship drive tunnels, (iii) the port and aft drive tunnels, (iv) the starboard and forward drive tunnels, (v) the starboard and midship drive tunnels, and (vi) the starboard and aft drive tunnels.

Example 6. The waterborne vessel of any one of Examples 1 or 2, the hull structure including vertical columns extending upward within or adjacent the side walls.

Example 7. The waterborne vessel of any one of Examples 5 or 6 further comprising multiple lifting anchors, a corresponding one of the lifting anchors being attached to each one of the vertical columns, the lifting anchors being structured to enable attachment to the hull structure of a lifting harness, a lifting carriage or cradle, or lifting cables.

Example 8. The waterborne vessel of any one of Examples 1 through 7, one or more of the one or more thrusters being movable from within the corresponding drive tunnels to a corresponding lowered position below the bottom surface of the hull structure, each such thruster being arranged in the lowered position to provide thrust in a direction determined by orientation of that thruster about the corresponding vertical axis.

Example 9. The waterborne vessel of any one of Examples 1 through 8 further comprising one or more ballast tanks positioned on or within the hull structure and arranged to provide the waterborne vessel with variable buoyancy.

Example 10. The waterborne vessel of any one of Examples 1 through 9 further comprising one or more batteries positioned on or within the hull structure and connected so as to provide power to the one or more thrusters.

Example 11. The waterborne vessel of any one of Examples 1 through 10 further comprising an umbilical connected to the waterborne vessel, the umbilical being structured to provide, between the waterborne vessel and a surface vessel, one or more of electrical power supplied to the waterborne vessel, control signals transmitted to the waterborne vessel, sensor signals transmitted from the waterborne vessel, or air or gas supplied to the waterborne vessel.

Example 12. The waterborne vessel of any one of Examples 1 through 11, the hull structure comprising a framework and skin.

Example 13. The waterborne vessel of Example 12, the framework comprising one or more metallic materials and the skin comprising one or more composite materials.

Example 14. The waterborne vessel of Example 13, the framework comprising titanium alloy and the skin comprising carbon, glass, or polymer fibers in a polymer resin binder.

Example 15. The waterborne vessel of any one of Examples 1 through 14 further comprising one or more winches arranged for pulling a payload onto the base portion through the open forward end or through the open aft end.

Example 16. A method employing the waterborne vessel of any one of Examples 1 through 15, the method comprising: (A) lowering the waterborne vessel into a body of water to a position adjacent a submerged target payload; (B) maneuvering one or both of the waterborne vessel or the target payload to position the target payload on the base portion of the hull structure between the side walls; and (C) raising the waterborne vessel toward a surface of the body of water with the target payload on the base portion of the hull structure between the side walls.

Example 17. The method of Example 16 wherein the target payload rests on the bottom surface of the body of water, and part (A) includes lower the waterborne vessel to rest on the bottom surface of the body of water adjacent the target payload.

Example 18. The method of any one of Examples 16 or 17 further comprising one or both of: (i) before part (A), moving the waterborne vessel across at least a portion of the body of water to a location of the submerged target payload; or (ii) after part (C), moving the waterborne vessel and the target payload across at least a portion of the body of water away from the location of the submerged target payload.

Example 19. The method of Example 18 wherein the waterborne vessel is connected to one or more lift, towing, or tug vessels and moved across at least a portion of the body of water by operation of one or more of the lift, towing, or tug vessels.

Example 20. The method of any one of Examples 16 through 19 wherein part (B) includes operating one or more or all of the thrusters with those thrusters positioned within the corresponding drive tunnels.

Example 21. The method of any one of Examples 16 through 20 wherein part (B) includes operating one or more or all of the thrusters with those thrusters positioned below a bottom surface of the hull structure.

Example 22. The method of any one of Examples 16 through 21 wherein part (B) includes operating one or more winches to pull the target payload onto the base portion through the open forward end or through the open aft end.

Example 23. The method of any one of Examples 16 through 22 wherein, after part (C), one or both of the waterborne vessel or the target payload are at least partly above the surface of the body of water.

Example 24. The method of any one of Examples 16 through 22 wherein, after part (C), the waterborne vessel and the target payload remain beneath the surface of the body of water.

Example 25. The method of any one of Examples 16 through 24 wherein the waterborne vessel is connected to one or more lift vessels and parts (A) and (C) include employing one or more of the lift vessels to raise and lower the waterborne vessel.

Example 26. The method of Example 25 wherein the waterborne vessel is connected to the one or more lift vessels using one or more of a lifting harness, a lifting carriage or cradle, drill pipe, or lifting cables.

Example 27. The method of any one of Examples 25 or 26 wherein the lifting harness, the lifting carriage or cradle, or the lifting cables are attached to corresponding lifting anchors attached to corresponding vertical columns of the hull structure that extend upward within or adjacent the side walls.

Example 28. The method of any one of Examples 16 through 27 wherein parts (A) and (C) include altering buoyancy of the waterborne vessel using one or more ballast tanks positioned on or within the hull structure.

Example 29. The method of any one of Examples 16 through 28 wherein part (C) includes operating one or more thrusters to drive water through corresponding drive tunnels and out through corresponding openings at the bottom surface of the hull structure.

Example 30. The method of any one of claims 16 through 29 further comprising, using an umbilical connecting the waterborne vessel to a surface vessel, one or more of (i) supplying electrical power to the waterborne vessel, (ii) transmitting control signals to the waterborne vessel, (iii) transmitting sensor signals from the waterborne vessel, or (iv) supplying air or gas to the waterborne vessel.

This disclosure is illustrative and not limiting. Further modifications will be apparent to one skilled in the art in light of this disclosure and are intended to fall within the scope of the present disclosure or appended claims. It is intended that equivalents of the disclosed example embodiments and methods, or modifications thereof, shall fall within the scope of the present disclosure or appended claims.

In the foregoing Detailed Description, various features may be grouped together in several example embodiments for the purpose of streamlining the disclosure. This method of disclosure is not to be interpreted as reflecting an intention that any claimed embodiment requires more features than are expressly recited in the corresponding claim. Rather, as the appended claims reflect, inventive subject matter may lie in less than all features of a single disclosed example embodiment. Therefore, the present disclosure shall be construed as implicitly disclosing any embodiment having any suitable subset of one or more features—which features are shown, described, or claimed in the present application—including those subsets that may not be explicitly disclosed herein. A "suitable" subset of features includes only features that are neither incompatible nor mutually exclusive with respect to any other feature of that subset. Accordingly, the appended claims are hereby incorporated in their entirety into the Detailed Description, with each claim standing on its own as a separate disclosed embodiment. In addition, each of the appended dependent claims shall be interpreted, only for purposes of disclosure by said incorporation of the claims into the Detailed Description, as if written in multiple dependent form and dependent upon all preceding claims with which it is not inconsistent. It should be further noted that the cumulative scope of the appended claims can, but does not necessarily, encompass the whole of the subject matter disclosed in the present application.

The following interpretations shall apply for purposes of the present disclosure and appended claims. The words "comprising," "including," "having," and variants thereof, wherever they appear, shall be construed as open ended terminology, with the same meaning as if a phrase such as "at least" were appended after each instance thereof, unless explicitly stated otherwise. The article "a" shall be interpreted as "one or more" unless "only one," "a single," or other similar limitation is stated explicitly or is implicit in the particular context; similarly, the article "the" shall be interpreted as "one or more of the" unless "only one of the," "a single one of the," or other similar limitation is stated explicitly or is implicit in the particular context. The conjunction "or" is to be construed inclusively unless: (i) it is explicitly stated otherwise, e.g., by use of "either . . . or," "only one of," or similar language; or (ii) two or more of the listed alternatives are understood or disclosed (implicitly or explicitly) to be incompatible or mutually exclusive within the particular context. In that latter case, "or" would be understood to encompass only those combinations involving non-mutually-exclusive alternatives. In one example, each of "a dog or a cat," "one or more of a dog or a cat," and "one or more dogs or cats" would be interpreted as one or more dogs without any cats, or one or more cats without any dogs, or one or more of each. In another example, each of "a dog, a cat, or a mouse," "one or more of a dog, a cat, or a mouse," and "one or more dogs, cats, or mice" would be interpreted as (i) one or more dogs without any cats or mice, (ii) one or more cats without any dogs or mice, (iii) one or more mice without any dogs or cats, (iv) one or more dogs and one or more cats without any mice, (v) one or more dogs and one or more mice without any cats, (vi) one or more cats and one or more mice without any dogs, or (vii) one or more dogs, one or more cats, and one or more mice. In another example, each of "two or more of a dog, a cat, or a mouse" and "two or more dogs, cats, or mice" would be interpreted as (i) one or more dogs and one or more cats without any mice, (ii) one or more dogs and one or more mice without any cats, (iii) one or more cats and one or more mice without any dogs, or (iv) one or more dogs, one or more cats, and one or more mice; "three or more," "four or more," and so on would be analogously interpreted.

For purposes of the present disclosure or appended claims, when a numerical quantity is recited (with or without terms such as "about," "about equal to," "substantially equal to," "greater than about," "less than about," and so forth), standard conventions pertaining to measurement precision, rounding error, and significant digits shall apply, unless a differing interpretation is explicitly set forth. For null quantities described by phrases such as "substantially prevented," "substantially absent," "substantially eliminated," "about equal to zero," "negligible," and so forth, each such phrase shall denote the case wherein the quantity in question has been reduced or diminished to such an extent that, for practical purposes in the context of the intended operation or use of the disclosed or claimed apparatus or method, the overall behavior or performance of the apparatus or method does not differ from that which would have occurred had the null quantity in fact been completely removed, exactly equal to zero, or otherwise exactly nulled.

For purposes of the present disclosure and appended claims, any labelling of elements, steps, limitations, or other portions of an embodiment, example, or claim (e.g., first, second, third, etc., (a), (b), (c), etc., or (i), (ii), (iii), etc.) is only for purposes of clarity, and shall not be construed as implying any sort of ordering or precedence of the portions so labelled. If any such ordering or precedence is intended, it will be explicitly recited in the embodiment, example, or claim or, in some instances, it will be implicit or inherent based on the specific content of the embodiment, example, or claim. In the appended claims, if the provisions of 35 USC § 112(f) are desired to be invoked in an apparatus claim, then the word "means" will appear in that apparatus claim. If those provisions are desired to be invoked in a method claim, the words "a step for" will appear in that method claim. Conversely, if the words "means" or "a step for" do not appear in a claim, then the provisions of 35 USC § 112(f) are not intended to be invoked for that claim.

If any one or more disclosures are incorporated herein by reference and such incorporated disclosures conflict in part or whole with, or differ in scope from, the present disclosure, then to the extent of conflict, broader disclosure, or broader definition of terms, the present disclosure controls. If such incorporated disclosures conflict in part or whole with one another, then to the extent of conflict, the later-dated disclosure controls.

The Abstract is provided as required as an aid to those searching for specific subject matter within the patent literature. However, the Abstract is not intended to imply that any elements, features, or limitations recited therein are necessarily encompassed by any particular claim. The scope of subject matter encompassed by each claim shall be determined by the recitation of only that claim.

What is claimed is:

1. A waterborne vessel comprising:

(a) a hull structure including a horizontal base portion, a port vertical side wall, and a starboard vertical side wall, the side walls being attached to the base portion in a generally longitudinal, transversely spaced-apart arrangement so that the hull structure has a generally U-shaped transverse cross-section, open forward and aft ends, and an open top;

(b) one or more longitudinal drive tunnels formed within and extending through the base portion of the hull structure;

(c) one or more transverse drive tunnels formed within and extending through the base portion of the hull structure and intersecting each of the one or more longitudinal drive tunnels; and (d) one or more thrusters, each thruster being located within a corresponding one of the one or more longitudinal drive tunnels and a corresponding one of the one or more transverse drive tunnels, at a corresponding intersection thereof, each thruster being arranged for driving water flow through the corresponding drive tunnels and being rotatable about a corresponding vertical axis among (i) a first thruster orientation in which the thruster is arranged to drive water flow in one direction through the longitudinal drive tunnel, (ii) a second thruster orientation in which the thruster is arranged to drive water flow in an opposite direction through the longitudinal drive tunnel, (iii) a third thruster orientation in which the thruster is arranged to drive water flow in one direction through the transverse drive tunnel, or (iv) a fourth thruster orientation in which the thruster is arranged to drive water flow in an opposite direction through the transverse drive tunnel.

2. The waterborne vessel of claim 1 further comprising one or more oblique drive tunnels formed within the base portion of the hull structure, each oblique drive tunnel extending horizontally from a corresponding one of the one or more intersections of longitudinal and transverse drive tunnels and terminating at a corresponding one of one or more openings on a bottom surface of the hull structure, the corresponding thruster at that intersection being rotatable to a fifth thruster orientation in which the thruster is arranged to drive water through the oblique drive tunnel and out through the corresponding opening at the bottom surface of the hull structure.

3. The waterborne vessel of claim 1, wherein:

(b') the one or more longitudinal drive tunnels include a port drive tunnel positioned below the port side wall and a starboard drive tunnel positioned below the starboard side wall;

(c') the one or more transverse drive tunnels include a forward transverse drive tunnel, a midship transverse drive tunnel, and an aft transverse drive tunnel; and (d') a corresponding one of the one or more thrusters is positioned at each of the intersections of (i) the port and forward drive tunnels, (ii) the port and midship drive tunnels, (iii) the port and aft drive tunnels, (iv) the starboard and forward drive tunnels, (v) the starboard and midship drive tunnels, and (vi) the starboard and aft drive tunnels.

4. The waterborne vessel of claim 3 further comprising four oblique drive tunnels formed within the base portion of the hull structure, each oblique drive tunnel extending inboard from a corresponding one of the intersections of (i) the port and forward drive tunnels, (ii) the port and aft drive tunnels, (iii) the starboard and forward drive tunnels, and (iv) the starboard and aft drive tunnels, each oblique drive tunnel terminating at a corresponding opening at a bottom surface of the base portion, each corresponding thruster being rotatable to a fifth thruster position in which the thruster is arranged to drive water through the corresponding oblique drive tunnel and out through the corresponding opening at the bottom surface of the hull structure.

5. The waterborne vessel of claim 3, the hull structure including vertical columns extending upward within or adjacent the side walls, a corresponding one of the vertical columns being positioned over each one of the intersections of (i) the port and forward drive tunnels, (ii) the port and midship drive tunnels, (iii) the port and aft drive tunnels, (iv) the starboard and forward drive tunnels, (v) the starboard and midship drive tunnels, and (vi) the starboard and aft drive tunnels.

6. The waterborne vessel of claim 1, the hull structure including vertical columns extending upward within or adjacent the side walls.

7. The waterborne vessel of claim 6 further comprising multiple lifting anchors, a corresponding one of the lifting anchors being attached to each one of the vertical columns, the lifting anchors being structured to enable attachment to the hull structure of a lifting harness, a lifting carriage or cradle, or lifting cables.

8. The waterborne vessel of claim 1, one or more or all of the one or more thrusters being movable from within the corresponding drive tunnels to a corresponding lowered position below the bottom surface of the hull structure, each such thruster being arranged in the lowered position to provide thrust in a direction determined by orientation of that thruster about the corresponding vertical axis.

9. The waterborne vessel of claim 1 further comprising one or more ballast tanks positioned on or within the hull structure and arranged to provide the waterborne vessel with variable buoyancy.

10. The waterborne vessel of claim 1 further comprising one or more batteries positioned on or within the hull structure and connected so as to provide power to the one or more thrusters.

11. The waterborne vessel of claim 1 further comprising an umbilical connected to the waterborne vessel, the umbilical being structured to provide, between the waterborne vessel and a surface vessel, one or more of electrical power supplied to the waterborne vessel, control signals transmitted to the waterborne vessel, sensor signals transmitted from the waterborne vessel, or air or gas supplied to the waterborne vessel.

12. The waterborne vessel of claim 1, the hull structure comprising a framework and skin.

13. The waterborne vessel of claim 12, the framework comprising one or more metallic materials and the skin comprising one or more composite materials.

14. The waterborne vessel of claim 13, the framework comprising titanium alloy and the skin comprising carbon, glass, or polymer fibers in a polymer resin binder.

15. The waterborne vessel of claim 1 further comprising one or more winches arranged for pulling a payload onto the base portion through the open forward end or through the open aft end.

16. A method employing the waterborne vessel of claim 1, the method comprising:

(A) lowering the waterborne vessel into a body of water to a position adjacent a submerged target payload;

(B) maneuvering one or both of the waterborne vessel or the target payload to position the target payload on the base portion of the hull structure between the side walls; and (C) raising the waterborne vessel toward a surface of the body of water with the target payload on the base portion of the hull structure between the side walls.

17. The method of claim 16 wherein the target payload rests on a bottom surface of the body of water, and part (A) includes lowering the waterborne vessel to rest on the bottom surface of the body of water adjacent the target payload.

18. The method of claim 16 further comprising one or both of:

(i) before part (A), moving the waterborne vessel across at least a portion of the body of water to a location of the submerged target payload; or (ii) after part (C), moving the waterborne vessel and the target payload across at least a portion of the body of water away from a location of the submerged target payload.

19. The method of claim 18 wherein the waterborne vessel is connected to one or more lift, towing, or tug vessels and moved across at least a portion of the body of water by operation of one or more of the lift, towing, or tug vessels.

20. The method of claim 16 wherein part (B) includes operating one or more or all of the one or more thrusters with those thrusters positioned within the corresponding drive tunnels.

21. The method of claim 16 wherein part (B) includes operating one or more or all of the one or more thrusters with those thrusters positioned below a bottom surface of the hull structure.

22. The method of claim 16 wherein part (B) includes operating one or more winches to pull the target payload onto the base portion through the open forward end or through the open aft end.

23. The method of claim 16 wherein, after part (C), one or both of the waterborne vessel or the target payload are at least partly above the surface of the body of water.

24. The method of claim 16 wherein, after part (C), the waterborne vessel and the target payload remain beneath the surface of the body of water.

25. The method of claim 16 wherein the waterborne vessel is connected to one or more lift vessels and parts (A) and (C) include employing one or more of the lift vessels to raise and lower the waterborne vessel.

26. The method of claim 25 wherein the waterborne vessel is connected to the one or more lift vessels using one or more of a lifting harness, a lifting carriage or cradle, drill pipe, or lifting cables.

27. The method of claim 26 wherein the lifting harness, the lifting carriage or cradle, or the lifting cables are attached to corresponding lifting anchors attached to corresponding vertical columns of the hull structure that extend upward within or adjacent the side walls.

28. The method of claim 16 wherein parts (A) and (C) include altering buoyancy of the waterborne vessel using one or more ballast tanks positioned on or within the hull structure.

29. The method of claim 16 wherein part (C) includes operating one or more of the one or more thrusters to drive water through corresponding drive tunnels and out through corresponding openings at a bottom surface of the hull structure.

30. The method of claim 16 further comprising, using an umbilical connecting the waterborne vessel to a surface vessel, one or more of (i) supplying electrical power to the waterborne vessel, (ii) transmitting control signals to the waterborne vessel, (iii) transmitting sensor signals from the waterborne vessel, or (iv) supplying air or gas to the waterborne vessel.

* * * * *